US007994912B2

(12) United States Patent
Inomata et al.

(10) Patent No.: US 7,994,912 B2
(45) Date of Patent: Aug. 9, 2011

(54) INTRUSION-OBJECT DETECTION SYSTEM, METHOD OF DETECTING INTRUSION-OBJECT AND METHOD OF DETECTING MALFUNCTION

(75) Inventors: Kenji Inomata, Tokyo (JP); Takashi Hirai, Tokyo (JP); Syuji Aizawa, Tokyo (JP); Noriyuki Miyake, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 19 days.

(21) Appl. No.: 12/160,380

(22) PCT Filed: Jan. 12, 2006

(86) PCT No.: PCT/JP2006/300258

§ 371 (c)(1),
(2), (4) Date: Nov. 12, 2009

(87) PCT Pub. No.: WO2007/080634

PCT Pub. Date: Jul. 19, 2007

(65) Prior Publication Data

US 2010/0238029 A1 Sep. 23, 2010

(51) Int. Cl.
*G08B 13/18* (2006.01)

(52) U.S. Cl. ..... 340/552; 340/561

(58) Field of Classification Search ..... 340/552–554, 340/561, 565, 567, 568.2, 540, 541, 545.3; 342/7, 8, 27, 28

See application file for complete search history.

(56) References Cited

U.S. PATENT DOCUMENTS

| | | | | |
|---|---|---|---|---|
| 5,247,270 | A * | 9/1993 | Harman et al. | 333/237 |
| 5,510,766 | A * | 4/1996 | Harman et al. | 340/552 |
| 5,705,984 | A * | 1/1998 | Wilson | 340/561 |
| 6,424,289 | B2 | 7/2002 | Fukae et al. | |
| 7,154,391 | B2 * | 12/2006 | Maki et al. | 340/552 |
| 7,456,739 | B2 * | 11/2008 | Inomata et al. | 340/552 |
| 7,564,540 | B2 * | 7/2009 | Paulson | 356/35.5 |
| 7,812,723 | B2 * | 10/2010 | Nishigaki et al. | 340/552 |
| 2008/0036597 | A1 * | 2/2008 | Harman | 340/552 |

FOREIGN PATENT DOCUMENTS

| | | |
|---|---|---|
| GB | 2 048 536 | 12/1980 |
| JP | 10 95338 | 4/1998 |
| JP | 2000 313335 | 11/2000 |
| JP | 2004 309423 | 11/2004 |
| WO | 2005 013223 | 2/2005 |

* cited by examiner

*Primary Examiner* — John A Tweel, Jr.

(74) *Attorney, Agent, or Firm* — Oblon, Spivak, McClelland, Maier & Neustadt, L.L.P.

(57) ABSTRACT

A method determining a malfunction when a reception signal fluctuates at a receiver owing to malfunctions occurring on a leaky cable and its related devices. The method determines, among range bins correlating the reception signal with a distance from a feed end of a radio-wave radiation unit and a radio-wave reception unit, based on a correlation between a time-delay from a transmission time of a transmission signal until a reception time of the reception signal and a transmission path distance of the reception signal in the radio-wave radiation unit and the radio-wave reception unit, when, comparing the reception signal with the transmission signal with respect to the range bin corresponding to a far end, a level of amplitude reduction in the reception signal exceeds a predetermined ratio, that a malfunction is present in either the radio-wave radiation unit or radio-wave reception unit.

10 Claims, 20 Drawing Sheets

INTRUSION-OBJECT DETECTION SYSTEM, METHOD OF DETECTING INTRUSION-OBJECT AND METHOD OF DETECTING MALFUNCTION

TECHNICAL FIELD

The present invention relates to intrusion-object detection systems in which, when an intrusion object is detected that approaches or passes through the surroundings of the radio-wave radiation cable by observing a fluctuation of electric field generated around a radio-wave radiation cable such as a leaky coaxial cable, even when a malfunction occurs in the radio-wave radiation cable, misoperation by the malfunction can be prevented, and it can be detected that the malfunction has occurred.

BACKGROUND ART

An intrusion detection system using a radio-wave radiation unit arranged in a cable form such as a leaky coaxial cable (hereinafter referred to as a "leaky cable") is based on the following principles.

For example, when a leaky cable is placed so as to enclose the perimeter of premises, the surroundings of the premises become a monitoring area. And, by generating an electric field around the leaky cable, when an intrusion object enters the premises thereacross, a domain of the electric field formed by the leaky cable is disturbed crosswise, so that a fluctuation of the electric field occurs owing to the intrusion object. By capturing the electric-field fluctuation, and also by detecting a position in which the electric-field fluctuation occurs, it is possible to find out the intrusion position.

Detection of an intrusion object according to the electric-field fluctuation is performed, for example, as follows.

With one end-point of a leaky cable for transmission being made as a feed end, a signal having pulse waves is inputted from the feed end and radiated from the leaky cable as a radio wave. While keeping constant space-intervals with the leaky cable for transmission, a leaky cable for reception is placed so that it receives a radio wave having been radiated from the leaky cable for transmission. As for the leaky cable for reception, a receiver is connected thereto at an end-point thereof, which is on the same side as the feed end of the leaky cable for transmission. By this receiver, a radio-wave signal received via the leaky cable for reception is received.

A signal through the medium of a radio wave that is radiated at a position near the feed end of the leaky cable and received thereat arrives fast at the receiver; a signal passing through a position away from the feed end and closer to the termination end arrives late at the receiver. Namely, a pulse wave that is a reception signal inputted into the receiver exhibits a waveform expanded in terms of time in comparison to the one having been transmitted.

While observing an envelope of the reception signal expanded in terms of time, when intrusion occurs, part of the envelope corresponding to the intrusion location exhibits an amplitude fluctuation. The presence of the intrusion object is detected from the amplitude fluctuation, and an intrusion position is traced from a location in which the envelope changes (for example, refer to Patent Document 1).

[Patent Document 1] Japanese Laid-Open Patent Publication No. H10-95338

DISCLOSURE OF THE INVENTION

Problems to be Solved by the Invention

Because a conventional intrusion detection system has been configured as described above, by observing changes in a reception signal at a receiver, existence of the changes is distinguished as an intrusion object; however, to what causes the changes in the reception signal at the receiver are originated, it is not treated as a problem. Other than an intrusion object, there are factors that cause a reception signal to fluctuate at the receiver; however, in the conventional intrusion detection system, even a fluctuation of the reception signal at the receiver caused by a factor other than the intrusion object is distinguished as an intrusion object, which has caused a problem.

As a fluctuation factor on a reception signal other than an intrusion object, there is damage to a conductor of a leaky cable.

When there is damage to conductors of the leaky cable, because reflection of a signal occurs at the damaged portion, strength of a signal that passes therethrough is reduced. Namely, the signal changes. Regardless of whether the damaged portion is on a transmitting side or a receiving side, changes in the signal strength eventually result in changes in a reception signal at the receiver. For this reason, the reception signal at the receiver changes owing to damage, and the change in the reception signal at the receiver is distinguished as an intrusion object. Namely, the damage to conductors of a leaky cable is distinguished as an intrusion object.

As another fluctuation factor on a reception signal other than an intrusion object, there is damage caused to slots.

In a radio-wave radiation unit in a cable form and a radio-wave reception unit in a cable form such as a leaky coaxial cable, there are cutouts called slots that are formed on a conductor shield. Even with a leaky waveguide, there are cutouts similar to those. When those slots are damaged, for example in a case in which the cutouts are widened, an influence is exerted on transmission or reception capabilities. For this reason, a transmission level or a reception level changes. Even in this case, because a reception signal eventually changes at a receiver, which is distinguished as an intrusion object, causing a problem.

In addition, there is a case in which a reception signal may fluctuate at the receiver depending also on changes in the surrounding environment of the leaky cable; when damage is distinguished based only on reduction in the amplitude of the reception signal at the receiver, which may cause a problem.

For example, when the multipath environment changes because of changes in the reflectance of the ground or a wall by rain or the like, the signals are cancelling out each other depending on conditions in a phase relation between a direct-path wave and reflection waves so that there may be a case in which the amplitude of the reception signal is partially reduced at the receiver. In this case, it causes an erroneous determination when damage is distinguished only based on reduction in the amplitude of the reception signal at the receiver.

In addition, there is a case in which a terminator that curbs unwanted reflections of a radio wave is connected to a termination end of the leaky cable. When, from some causes, for example, due to deterioration over time or the like, the resistance of a terminator resistor has changed, a reception signal eventually changes at the receiver. For this reason, even when a cause is due to failure of the terminator, it is distinguished as an intrusion object, causing a problem.

As described above, in a conventional intrusion detection system, when damage is caused to a leaky cable or the terminator connected thereto, or when the surrounding environment changes, it is erroneously distinguished as an intrusion object, which has caused a problem.

In addition, as a matter of course, it is not possible to detect at which position viewed from a transmission/reception end the damage is caused. Moreover, it is not possible to distinguish on which side the damage is caused, a transmitting side or a receiving side.

The present invention has been directed at providing a method of determining that a malfunction is present, without erroneously detecting it as an intrusion object, when a reception signal fluctuates at the receiver owing to damage, breakage, a crack caused to a leaky cable or a terminator connected to the leaky cable, or changes in the surrounding environment of the leaky cable. In addition, another object is to provide a method that is capable of finding out a position in which the malfunction is present.

Unit for Solving the Problems

A method of detecting a malfunction comprises: radiating as a radio wave, by a radio-wave radiation unit in a cable form with one end thereof as a feed end and the other end thereof as a far end, a transmission signal on which a spread spectrum signal is superimposed being fed into the radio-wave radiation unit from the feed end; receiving the radio wave by a radio-wave reception unit in a cable form, placed approximately in parallel with the radio-wave radiation unit; receiving the transmission signal as a reception signal at an end on the feed-end side of the radio-wave reception unit; defining the reception signal with respect to range bins each correlated with a distance from a position of the feed end, on the radio-wave radiation unit and the radio-wave reception unit, based on a correlation between a time-delay from transmission time of the transmission signal until reception time of the reception signal and the distance along a transmission path according to route's positions on the radio-wave radiation unit and the radio-wave reception unit in the transmission path through which the transmission signal passes after its transmission until reception as the reception signal, by comparing a code sequence of a spread spectrum signal extracted from the reception signal with a code sequence of a spread spectrum signal in the transmission signal; and determining that a malfunction is present in either the radio-wave radiation unit or the radio-wave reception unit, when, comparing the reception signal with the transmission signal for the range bins corresponding to the far end, a level of amplitude reduction in the reception signal exceeds a predetermined ratio.

In addition, a method of detecting a malfunction comprises: determining, with respect to each of the range bins, a level of amplitude reduction in the reception signal compared with the transmission signal, and detecting, out of the range bins in which the level of amplitude reduction exceeds a predetermined ratio, a range bin that corresponds to the nearest position to the feed end, so as to determine that a malfunction is present in a position corresponding to that range bin related to either the radio-wave radiation unit or the radio-wave reception unit.

Effects of the Invention

It is possible to detect not only an intrusion object, but also a malfunction of a leaky cable. According to this arrangement, it becomes possible to detect not only an intrusion object, but also an electric-field fluctuation owing to damage to the cable, and it becomes possible to prevent erroneously detecting as an intrusion object an electric-field fluctuation owing to damage to the cable. In addition, it is possible to detect not only presence or absence of a malfunction, but also the position thereof.

EXPLANATION Of NUMERALS AND SYMBOLS

"110," designates a signal generation unit;
"120," signal reception unit;
"130," correlators;
"151," intrusion-object distinguishing unit;
"152," malfunction distinguishing unit;
"153," malfunction-range measurement unit;
"154," breakage detection unit;
"155," crack detection unit;
"156," determination-result display unit;
"157," crack immediate-report unit;
"158," intrusion-object immediate-report unit;
"201," leaky cable as radio-wave radiation unit in cable form;
"203," "233," "303," "333," terminators;
"204," "234," "304," "334," reflectors; and
"301," leaky cable as radio-wave reception unit in cable form.

BEST MODE FOR CARRYING OUT THE INVENTION

Embodiment 1

Figure 1:
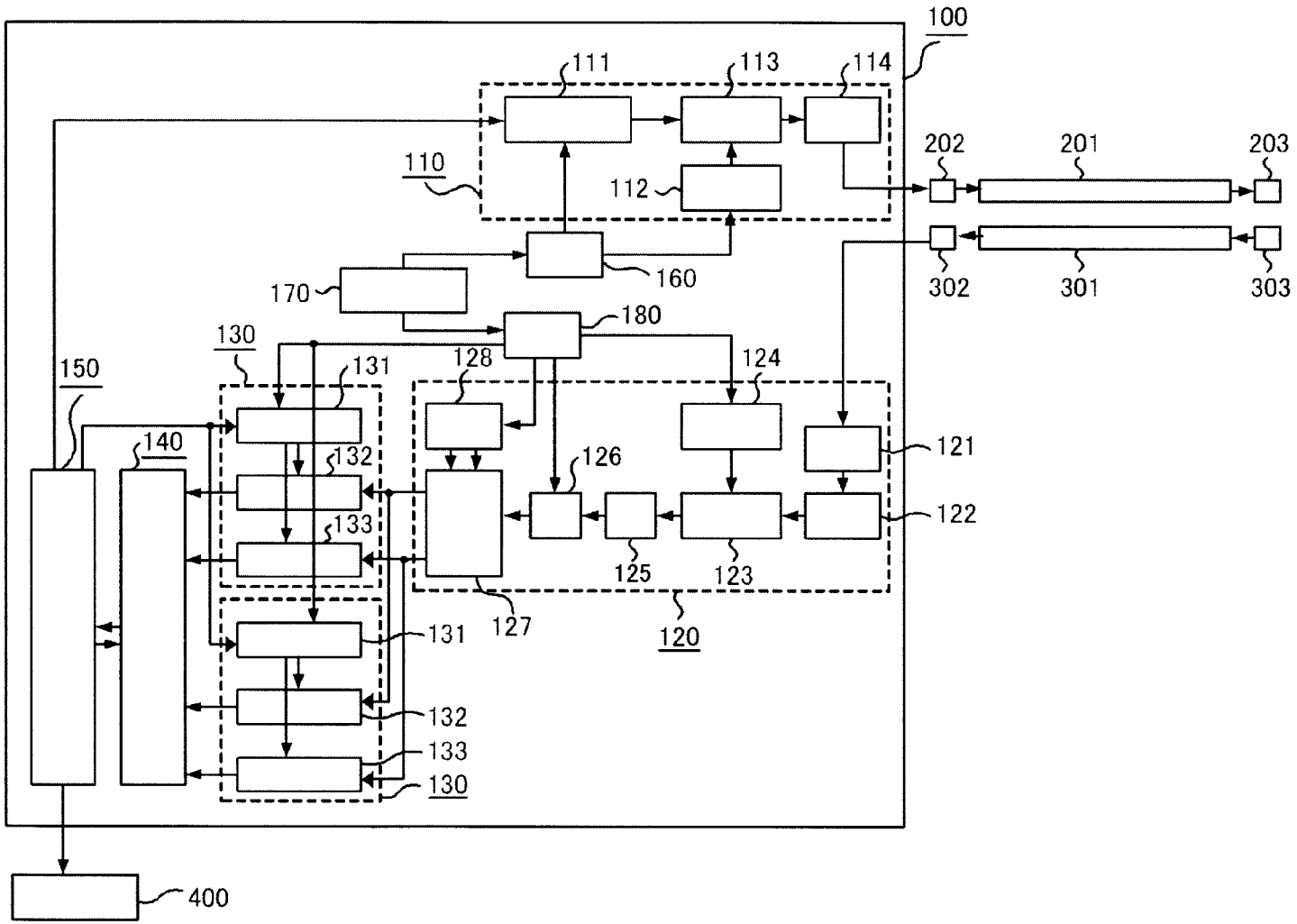
FIG. 1 is a block diagram showing a configuration of an apparatus in Embodiment 1 of the present invention.

In FIG. 1, a block diagram is shown for explaining a configuration of an apparatus in Embodiment 1 of the present invention.

A signal outputted from a signal generation unit 110 of a sensor 100 is radiated from a leaky cable 201 as a radio wave, and it is received by a leaky cable 301. The received signal is received by a signal reception unit 120 of the sensor 100 and demodulated by correlators 130 each of which is a signal demodulation unit; the result is written into a memory 140. By analyzing the written result by software that is executed on a CPU 150, intrusion detection and malfunction detection of the leaky cable 201 or the leaky cable 301 are performed.

The signal generation unit 110 includes a PN code generator 111, an oscillator 112, a modulator 113 and an amplifier 114.

The PN code generator 111 generates, obeying instructions of the CPU 150, a predetermined PN code with reference to an output clock signal from a PLL oscillator 160. Note that, the PN code is a pseudo spread spectrum code such as the M-sequence or the GOLD sequence usually used in spread spectrum communications. The PLL oscillator 160 outputs a clock signal of a predetermined frequency with reference to an output from a reference clock 170. An output from the PN code generator 111 is inputted into the modulator 113. In the modulator 113, by using an output from the oscillator 112 that operates with reference to an output from the reference clock 170 as a carrier wave, phase modulation is performed on the output from the PN code generator 111, so that the modulated output is sent out to the amplifier 114. An output from the amplifier 114 is inputted into the leaky cable 201 by way of a coaxial cable 202.

The leaky cable 201 is a "radio-wave radiation unit arranged in a cable form"; for example, a leaky coaxial cable (LCX) may be utilized. A signal inputted into the leaky cable 201 through the coaxial cable 202 is radiated into space from the leaky cable 201 as a radio wave. At an end on the opposite side to the sensor 100 (hereinafter referred to as a "far end"), a terminator 203 is connected to the leaky cable 201, which absorbs a signal that is not radiated therefrom.

A radio wave radiated from the leaky cable 201 is received by the leaky cable 301. The leaky cable 301 is a "radio-wave reception unit arranged in a cable form" similar to the leaky cable 201. The leaky cable 301 is generally placed approximately in parallel with the leaky cable 201; however, it is not necessary to place them completely in parallel with each other; the mutual spacing may be partially widen or narrowed. At an end on the opposite side to the sensor 100, namely at the far end, a terminator 303 is connected to the leaky cable 301; regarding a signal received by the leaky cable 301, the terminator 303 absorbs part of the signal that propagates thereto. Part of the signal that is received by the leaky cable 301 and propagates toward the sensor 100 passes through a coaxial cable 302, and is inputted into the signal reception unit 120.

The signal reception unit 120 is made up of the elements from a filter 121 through a quadrature demodulator 127 as to be explained below.

The filter 121 removes, from the signal inputted by way of the coaxial cable 302, a signal portion with an unwanted spectrum that is different from the spectrum of radio wave the leaky cable 201 radiates, so as to send the signal to an amplifier 122. The amplifier 122 amplifies the inputted signal up to a predetermined level, so as to send the signal to a multiplier 123.

The multiplier 123 mixes an output from the amplifier 122 with an output from an oscillator 124 used as a local signal, and outputs the mixed signal through a band-pass filter 125 (hereinafter referred to as BPF) that passes only required frequency components to an A/D converter 126. The A/D converter 126 converts the inputted signal into a digital signal, and sends the signal to the quadrature demodulator 127. The quadrature demodulator 127 performs quadrature detection on an output from the A/D converter 126 based on outputs from a direct digital synthesizer 128 (hereinafter referred to as DDS).

Here, the quadrature detection is also called as I/Q detection; thereby, with reference to reference signals, that is, the outputs from the DDS 128, an input signal from the A/D converter 126 is separated into an in-phase component (hereinafter referred to as an "I-component") and a quadrature component (hereinafter referred to as a "Q-component"). By the quadrature detection, the carrier wave is removed, so that baseband components are outputted.

Note that, a low-pass filter (LPF) is internally mounted in the output stages each of the quadrature demodulator 127 that is configured so that components in a high frequency band are removed and only a required low frequency band component (baseband component) is outputted.

In addition, the oscillator 124 operates with reference to an output from the reference clock 170, and the A/D converter 126 and the DDS 128 operate with reference to a clock signal that a PLL oscillator 180 outputs. In addition, the PLL oscillator 180 outputs a clock signal of a predetermined frequency with reference to the reference clock 170.

Outputs from the quadrature demodulator 127 of the signal reception unit 120 are inputted into each of the correlators 130 that are the signal demodulation unit. The correlators 130 each detect an I-component and a Q-component of a reception signal obtained by the quadrature detection; each of the correlators is made up of a PN code generator 131, a correlation integrator 132 and a correlation integrator 133.

The PN code generator 131 generates a PN code sequence identical to that from the PN code generator 111 of the signal generation unit 110. However, the PN code generator 131 has a function to generate a PN code in a predetermined code phase, according to instructions of the CPU 150.

The code phase affects the start bit of a PN code sequence. For example, given that the length of the PN code used is "L" chips that are expressed as PN(0), PN(1), . . . , PN(L−1), when, while the PN code generator 111 is outputting as PN(0), PN(1), PN(2), . . . , PN(L−1), PN(0), . . . , the PN code generator 131 outputs a PN code sequence that is shifted forward by one chip with respect to the output from the PN code generator 111 such as PN(L−1), PN(0), PN(1), . . . , PN(L−2), PN(L−1), . . . ; the code phase is "−1".

Note that, the operations to generate a PN code sequence in a predetermined code phase is possible to accomplish with ease, when the PN code sequence is stored in a memory or the like, by making an adjustment to an initial value of the address to be read out. In addition, when using a shift register with a feedback tap, which is a general method to generate a PN code, it is only necessary to modify an initial value of the shift register.

The output from the PN code generator 131 is inputted into the correlation integrator 132 and the correlation integrator 133. In addition, among the outputs from the quadrature demodulator 127 of the signal reception unit 120, an I-component is inputted into the correlation integrator 132, and a Q-component is inputted into the correlation integrator 133.

The correlation integrator 132 multiplies an output from the PN code generator 131 with the I-component output from the quadrature demodulator 127, and outputs a multiplication result after having integrated it for a specified time-period. The integration time-period is set to, by letting one cycle of a PN code as a unit, an integral multiple value thereof.

The correlation integrator 133 multiplies an output from the PN code generator 131 with the Q-component output from the quadrature demodulator 127, and outputs a multiplication result after having integrated it for the same time-period as that for which the correlation integrator 132 integrates.

Reverse spectrum diffusion is executed by the multiplication and integration. The correlation integrator 132 and the correlation integrator 133 output an I-component and a Q-component of the reversely diffused signal, respectively.

As for the PN code, when a code phase is zero, namely, when there is no phase shift, a correlation value becomes very large. On the other hand, when the code phase is other than zero, namely, when the phase is shifted, the correlation value takes a very small value. When the phase is shifted, to what extent the correlation value will be small depends on the contents and the length of a PN code sequence; however, by sufficiently increasing the code length, it is possible to make the degree small enough to the extent in which a problem is not caused in calculation processing.

Along a signal transmission path from the signal generation unit 110 to the signal reception unit 120, because of differences in positions radiated from the leaky cable 201 and received by the leaky cable 301, propagation distances of a signal differ, so that delay occurs in propagation of the signal. The difference of a code phase in a PN code sequence described above changes depending mainly on the propagation time-delay.

To this end, in the present invention, by letting propagation time from a signal transmission to its reception as a reference, range bins into which a reception signal is divided are used. Because a propagation delay of the signal in internal circuitry of the sensor 100, propagation velocities of the signal in the leaky cable 201 and the leaky cable 301, and a propagation velocity of a radio wave in space are known in advance, a propagation time-delay can be converted into positions in the leaky cable 201 and the leaky cable 301. Therefore, each of the range bins can be correlated with each of the positions of the leaky cable.

Namely, from the code phase of the PN code generator 131, an I-component and a Q-component of an arbitrary propagation time-delay can be obtained. This shows that each of the correlators 130 outputs a set of values of one range bin corresponding to an initial value of a generated PN code used by the correlators 130 each. By preparing a lot of such correlators 130 and giving them continuously different code phases each, it is possible to cope with a reception signal that passes through arbitrary positions of the leaky cable 201.

Outputs from each of the correlators 130 are an I-component and a Q-component of the corresponding range bin. From the I-component and the Q-component, by deriving the square root of sum of squares, the amplitude can be obtained, and by deriving an arctangent, the phase, respectively.

The outputs from the correlators 130 corresponding to each of the range bins are stored into the memory 140 as a quadrature-detection result 141. Namely, in the memory 140, I-components and Q-components corresponding to all the range bins are stored.

Figure 2:
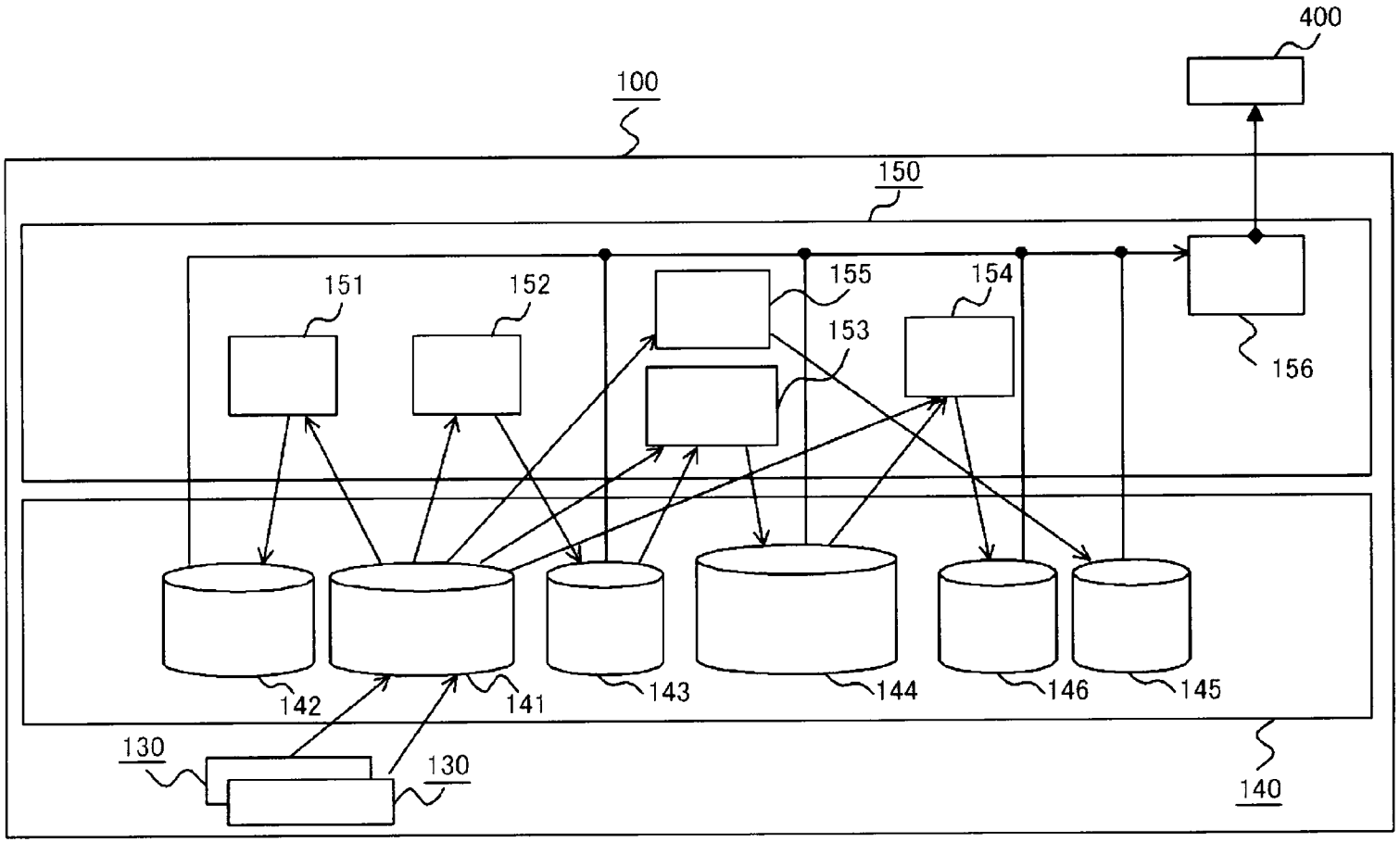
FIG. 2 is a block diagram illustrating a configuration of the functions in Embodiment 1 of the present invention.

As shown in FIG. 2, an intrusion-object distinguishing unit 151 that operates on the CPU 150 refers to the quadrature-detection result 141, namely, the I-components and Q-components, and outputs intrusion-object information 142; the processing is performed by the following operations.

The intrusion-object distinguishing unit 151 obtains the amplitude by deriving the square root of sum of squares from an I-component and a Q-component of each of the range bins, and in addition, the phase by deriving an arctangent; by monitoring variation of the amplitude and the phase obtained, detection is performed whether or not there exists a fluctuation, owing to an intrusion object, in a reception signal that is received with a propagation time-delay corresponding to each of the range bins. The fluctuation owing to the intrusion object is determined, when the amplitude or the phase of a signal corresponding to each of the range bins indicates variation larger than the quantity of variation predetermined by experiment or the like.

As for each of the range bins, when presence of a fluctuation owing to the intrusion object is determined, information related to the range bin is written into the memory 140.

A detection result of the intrusion object is displayed on a display device 400.

Figure 3:
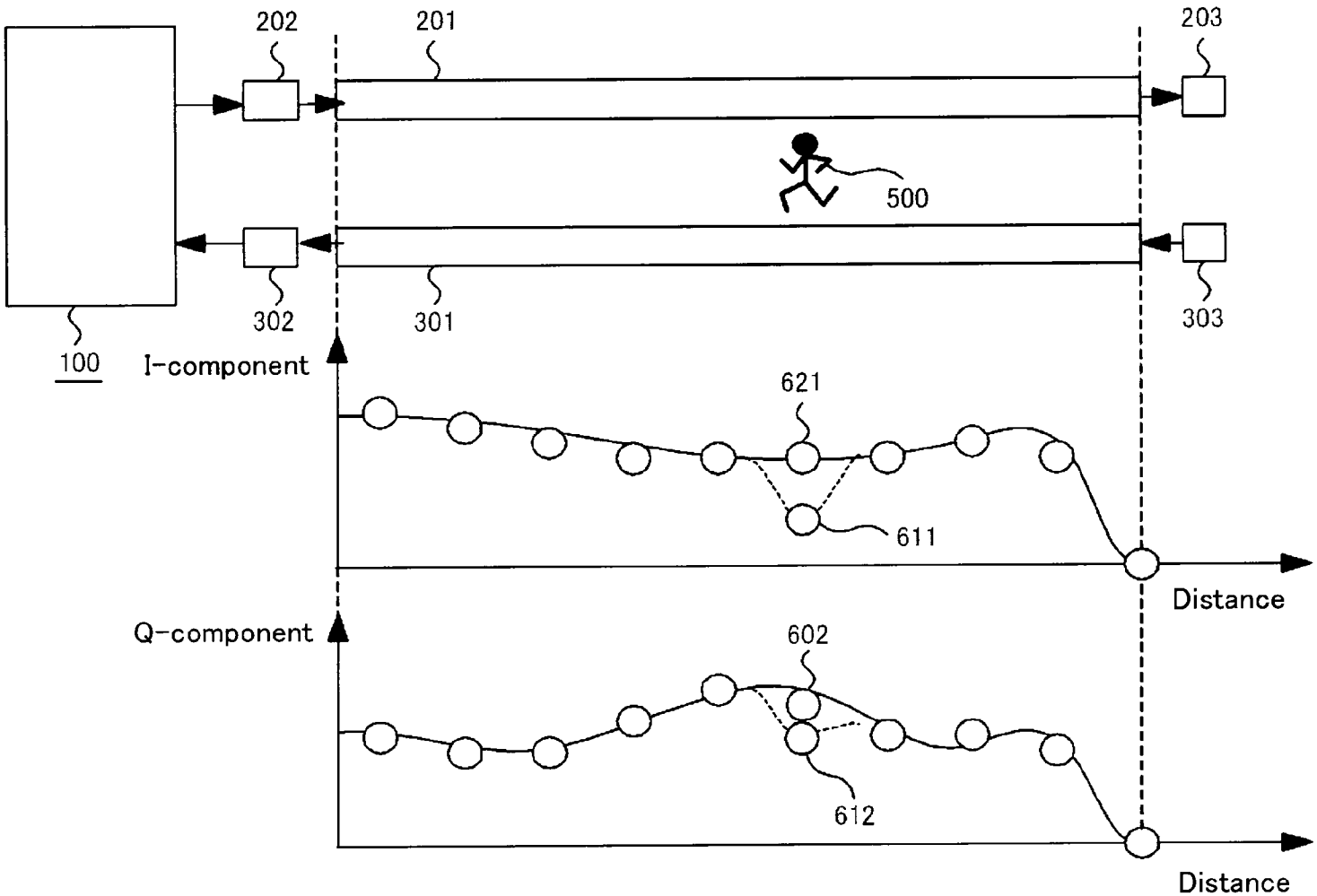
FIG. 3 is a diagram for explaining operating principles in Embodiment 1 of the present invention.

The operations of the intrusion-object detection described above will be explained using FIG. 3. FIG. 3 shows a state in which an intrusion object 500 intrudes into a detection range of an intrusion-object detection system according to the present invention. In addition, below the leaky cable 201 and the leaky cable 301 shown in FIG. 3, values of an I-component and a Q-component of a range bin corresponding to each of positions are shown as graphs, respectively.

The horizontal axes denote a "distance," and the vertical axes each denote the magnitude of I-component and the magnitude of Q-component. In the figure, a circular mark 611 and a circular mark 612 indicate, in a state in which the intrusion object 500 is present, a value of I-component and a value of Q-component of a range bin corresponding to the position of the intrusion object 500, respectively. On the other hand, a circular mark 621 and a circular mark 602 indicate, in a state in which the intrusion object 500 is not present, a value of I-component and a value of Q-component of the range bin, respectively.

As shown in the figure, when the intrusion object is present, because an I-component and a Q-component fluctuate in the range bin corresponding to the intrusion position, by determining the amount of fluctuation using a predetermined threshold value, it becomes possible to detect the presence or absence of the intrusion object, and to locate the position of the intrusion object.

Next, the operations will be explained to distinguish changes in a reception signal owing to causes by such damage to a leaky cable other than an intrusion object.

As shown in FIG. 2, a malfunction distinguishing unit 152 receives an I-component and a Q-component as inputs, and outputs malfunction presence-absence information that indicates presence or absence of a malfunction such as breakage.

The operations of the malfunction distinguishing unit 152 is, by using the I-components and Q-components stored in the memory 140, to extract changes in a reception signal by a signal being reflected owing to a malfunction such as breakage of the leaky cable at a place in which the malfunction is present, by the malfunction distinguishing unit 152 that operates on the CPU 150.

As for breakage of the leaky cable, when the breakage is caused to the leaky cable 201, a level of a signal is reduced from a breakage point to the termination end. On the other hand, when the breakage is caused to the leaky cable 301, a level of the signal being transmitted to the sensor 100 is reduced as to the signal that has been received from between the breakage point and the terminator. For this reason, an I-component and a Q-component of the range bins each corresponding to positions beyond the breakage point are made significantly small.

The malfunction distinguishing unit 152 calculates the amplitude from an I-component and a Q-component in the range bin corresponding to the position of the far end; when the obtained amplitude falls below a threshold value predetermined by experiment, the malfunction presence-absence information 143 in the memory 140 is updated, and information that "a malfunction has been detected" is written into the memory.

Note that, reduction in the amplitude of reception signal owing to reflections by a malfunction such as breakage of the leaky cable causes a large fluctuation in comparison to reduction in the amplitude of reception signal owing to an intrusion object; therefore, as described above, it is possible to detect a malfunction such as breakage by only determining in the range bin corresponding to a position of the far end. In addition, as for a threshold value, the value is large in comparison to the one used for the detection of an intrusion object.

Figure 4:
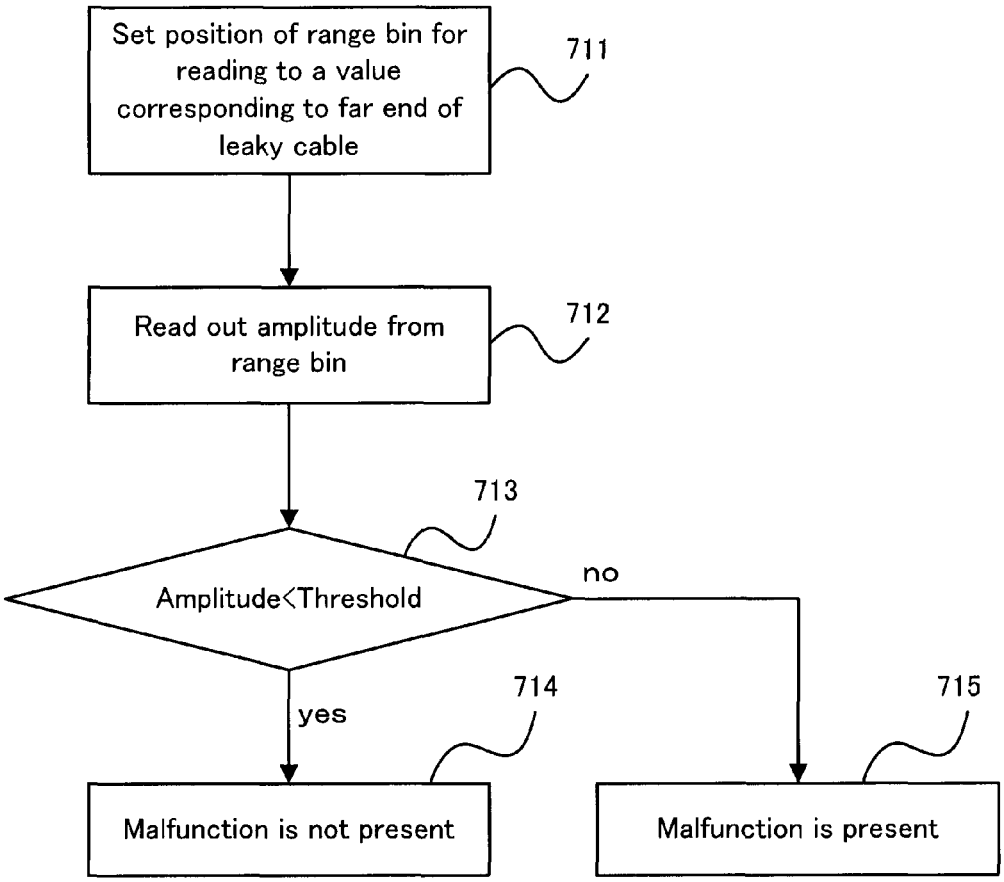
FIG. 4 is a flowchart for explaining the operations of a malfunction distinguishing unit in Embodiment 1 of the present invention.

An example of the operations of the malfunction distinguishing unit 152 is shown by a flowchart in FIG. 4.

First, in Block 711, a position of a range bin for reading is set to a value that corresponds to the termination end of the leaky cable. Hereinafter, the range bins are so arranged that, unless otherwise noted, zero-th in order is positioned at a starting point of the leaky cable; they are sequenced in such a way that the larger their number, the greater distance they observe.

Next, in Block 712, the amplitude is read out from the range bin that is currently set to a position for reading. At this time, as an actual operation, corresponding data is thus read out from the memory 140.

Next, in Block 713, determination is performed so that, when the amplitude having been read is falling below a threshold value, Block 714 ensues; when exceeding the threshold value, Block 715 ensues. Here, the threshold value is predetermined by experiment.

In Block 714, determination is performed so that "a malfunction is not present"; in Block 715, determination is performed so that "a malfunction is present."

Owing to a malfunction, an influence is exerted on range bins beyond the range bin corresponding to a breakage point; therefore, the breakage point is a position corresponding to the range bin closest to the transmitting side in a range in which a malfunction occurs. By investigating the number of the range bin, the distance can be calculated from the number of the range bin.

According to this principle, as shown in FIG. 2, a malfunction-range measurement unit 153 further searches, based on the I-component and Q-component, a range in which a malfunction occurs, and outputs the result as cable breakage-point information.

Figure 5:
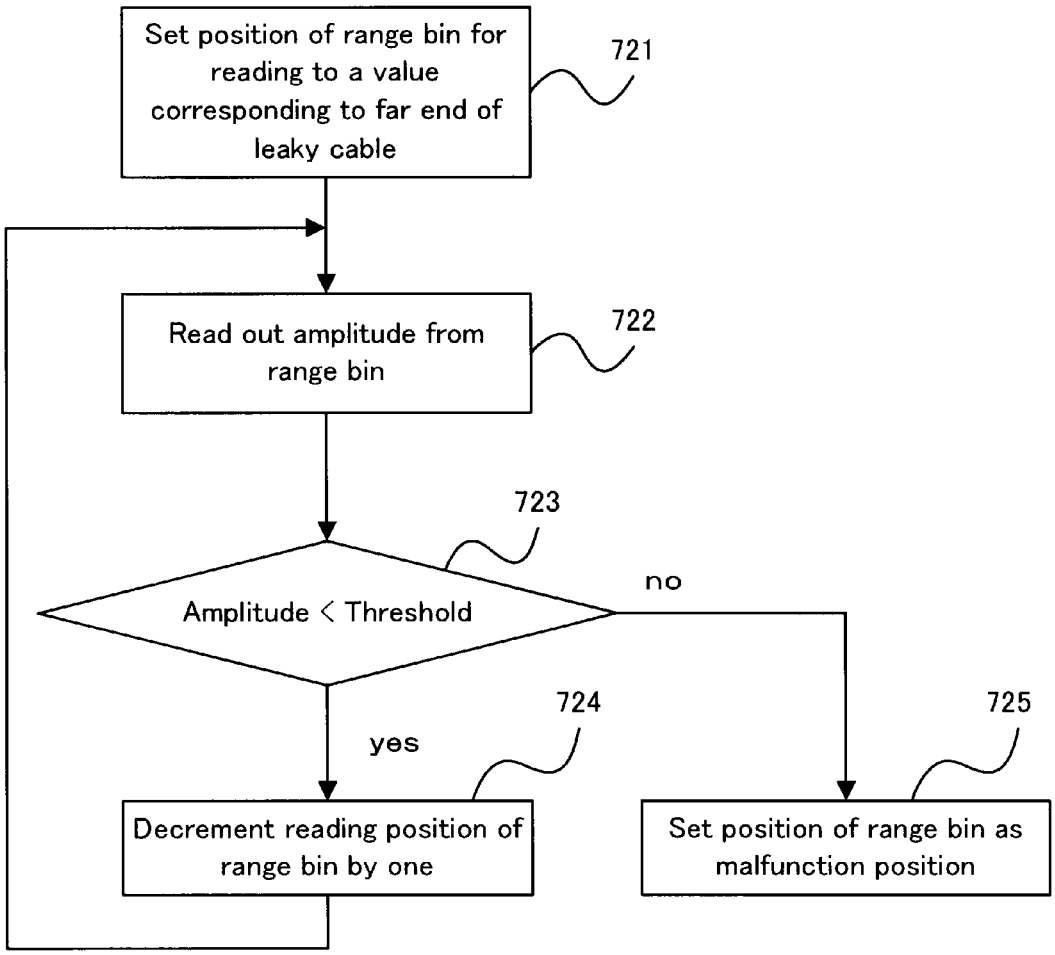
FIG. 5 is a flowchart for explaining the operations of a malfunction-range measurement unit in Embodiment 1 of the present invention.

By using a flowchart in FIG. 5, the operational flows of the malfunction-range measurement unit 153 will be explained.

First, in Block 721, a position of a range bin for reading is set to a value that corresponds to the termination end of the leaky cable. The range bins are so arranged that, unless otherwise noted, zero-th in order is positioned at a starting point of the leaky cable; they are sequenced in such a way that the larger their number, the greater distance they observe.

Next, in Block 722, the amplitude is read out from a range bin that is currently set to a position for reading.

Next, in Block 723, determination is performed so that, when the amplitude having been read is falling below a threshold value, Block 724 ensues; when exceeding the threshold value, Block 725 ensues.

In Block 724, a reading position of a range bin is decremented by one, so that Block 722 ensues. Namely, it is regarded that a boundary of a "malfunction range" is not reached, so that the processing is continued.

In Block 725, because a boundary of a "malfunction range" is found to be reached, a position of the current range bin is set as a "malfunction position," so that the processing is ended.

As described above, according to the operations of the malfunction-range measurement unit 153, an amplitude level is examined from the far end of the leaky cable; when a normal amplitude level is found to be reached, the number of range bin is thus outputted to the memory 140, so that the processing is ended. Namely, the number of the range bin that is likely to be a cable's breakage point is outputted to the memory 140.

Next, a breakage detection unit 154 will be explained.

The malfunction distinguishing unit 152 and the malfunction-range measurement unit 153 detect cable's breakage using a phenomenon in which a signal is substantially decreased; on the other hand, the breakage detection unit 154 detects cable's breakage using another phenomenon so as to strengthen detection accuracy.

The breakage detection unit 154 uses malfunction-position information 144 that the malfunction-range measurement unit 153 has outputted in determination, and as shown in FIG. 2, outputs breakage presence-absence information, by referring to the quadrature-detection result 141 and the malfunction-position information 144.

When a leaky cable is broken, a signal is reflected at the breakage point. And, when the breakage point is present on the leaky cable 201, the reflected signal is radiated from the leaky cable 201 as a radio wave; the radio wave is received by the leaky cable 301, and inputted into the sensor 100. In the meantime, when the breakage point is present on the leaky cable 301, regarding a signal radiated from the leaky cable 201 and received by the leaky cable 301, the signal that propagates toward the far end is reflected at the breakage point, and inputted into the sensor 100.

Figure 6:
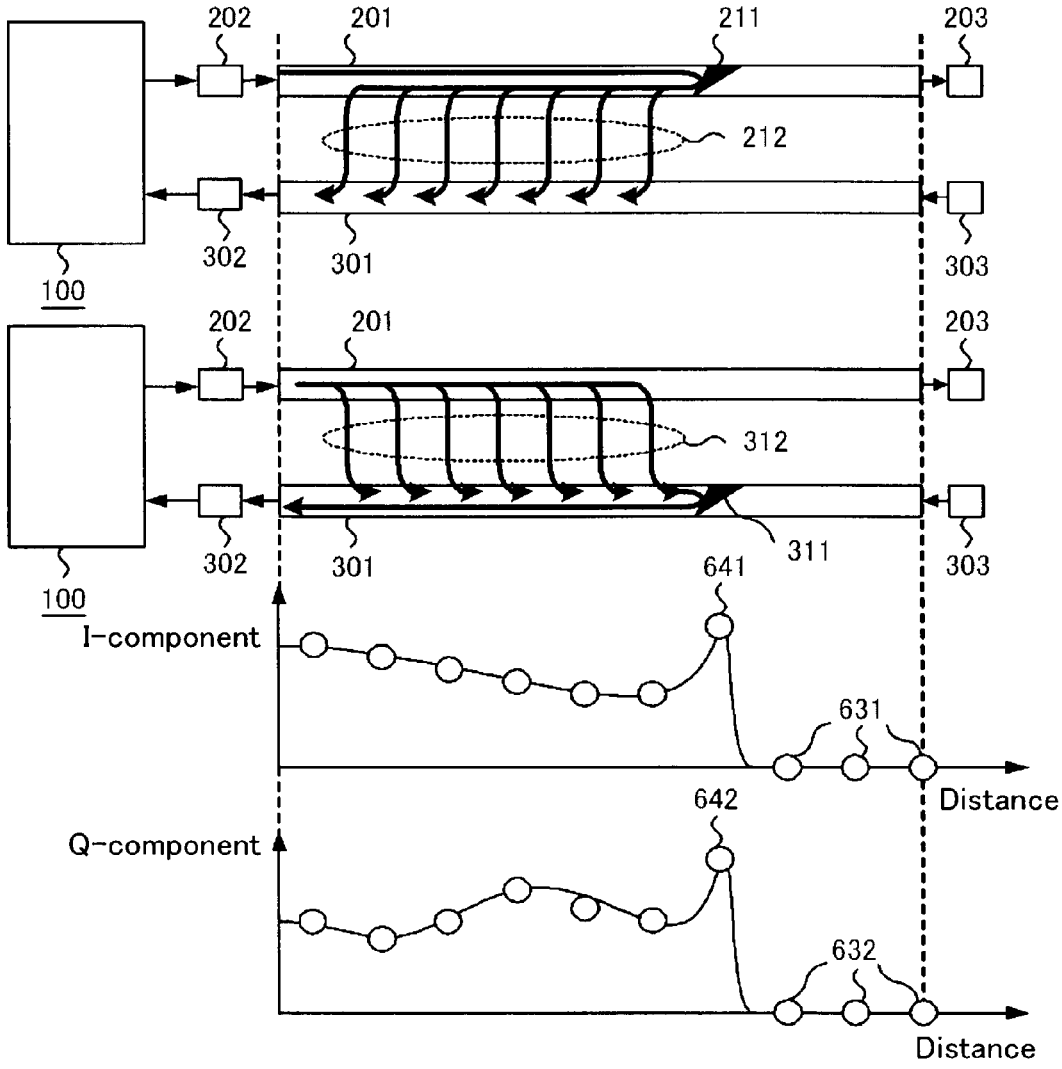
FIG. 6 is a diagram for explaining operating principles of breakage detection in Embodiment 1 of the present invention.

The situation will be explained using FIG. 6. In the two pairs of the leaky cables in the upper portion of FIG. 6, the top pair shows a case in which a breakage point 211 is present in the leaky cable 201; the subsequent pair shows a case in which a breakage point 311 is present in the leaky cable 301. In both cases, because of the breakage caused in the leaky cables each, values of range bins 631 and range bins 632 beyond the breakage point are made significantly small.

On the other hand, the reflected signal at the breakage point as explained before is added here. Signal paths 212 are signal paths reflected by the breakage point caused on the leaky cable 201; signal paths 312 are signal paths reflected by the breakage point caused on the leaky cable 301. Components of these signal paths 212 and signal paths 312 appear at respective positions of a range bin 641 and a range bin 642, so that the amplitude of a range bin that exactly corresponds to the breakage point increases.

As described above, by determining based on a predetermined threshold value that the amplitude of a range bin rises, and the amplitude of the range bins beyond that place is made significantly small, it is possible to more precisely detect cable's breakage.

Figure 7:
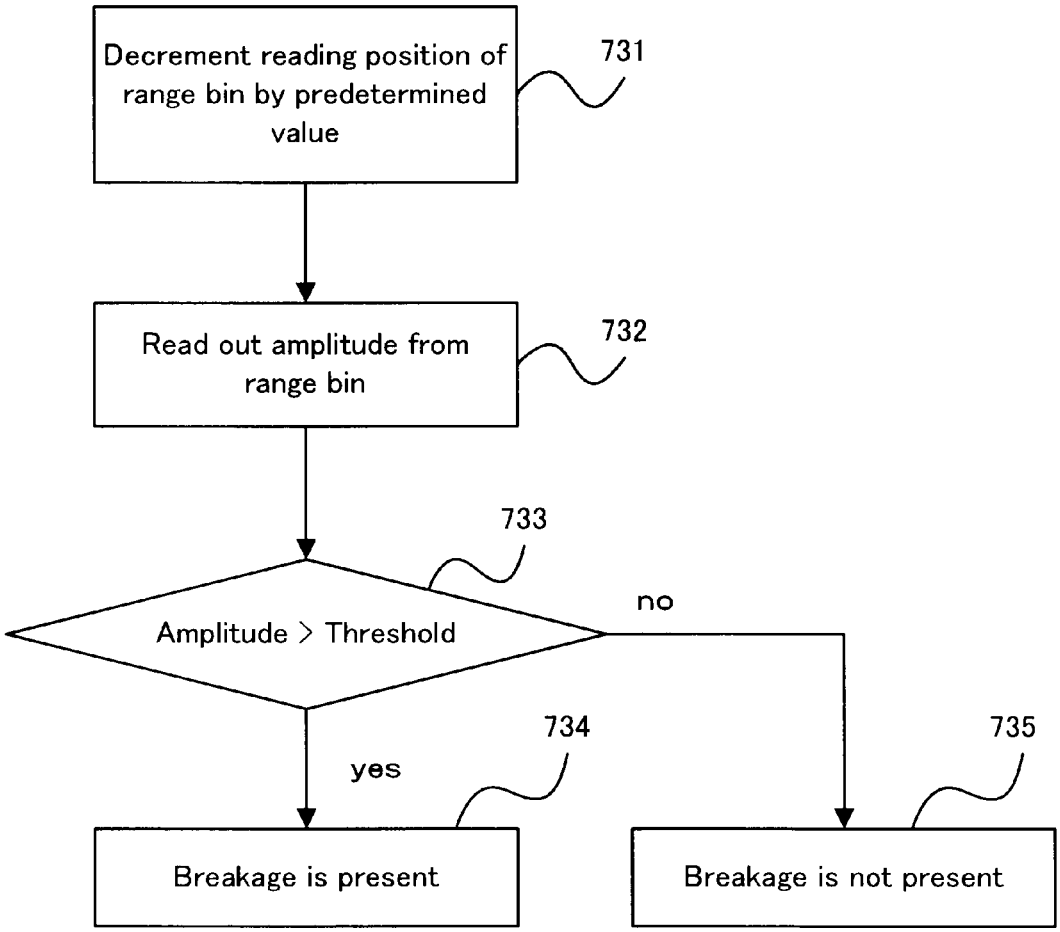
FIG. 7 is a flowchart for explaining the operations of a breakage detection unit in the present invention.

Using a flowchart in FIG. 7, the operational flows of the breakage detection unit 154 will be explained.

First, using the number of range bin indicated by the malfunction-position information 144 in which the malfunction-range measurement unit 153 has determined, the processing is started. In Block 731, the range bin number is modified to a small value by a predetermined value. The predetermined value is determined depending on resolution of the range bin. When the resolution is sufficient, the value is set to one.

Next, in Block 732, the amplitude of the modified range bin number is calculated based on an I-component and a Q-component having been read out from the memory 140.

Next, in Block 733, threshold-based determination is performed; when the amplitude exceeds a predetermined threshold value, Block 734 ensues; when it does not exceed, Block 735 ensues.

In Block 734, the determination is performed as "breakage is present," so that the processing is ended; in Block 735, the determination is performed as "breakage is not present," so that the processing is ended. When the breakage detection unit 154 has determined that breakage is present, the determination result as "a malfunction is present" by the malfunction distinguishing unit 152 is further confirmed.

Next, a crack detection unit 155 that detects abnormality produced by a crack or a distortion of a cable will be explained. As shown in FIG. 2, the crack detection unit 155 refers to the I-components and Q-components in the quadrature-detection result 141, and outputs breakage presence-absence information.

When a crack is present on a leaky cable, the cracked portion contacts and separates owing to expansions and contractions, or vibrations of the leaky cable. Because the characteristic impedance of the cable when contacting is different from that when separating, through repetition of this state, the characteristic impedance changes at all times. In addition, even by a crack having been accelerated, the characteristic impedance changes.

And, when there is a point in which the characteristic impedance is different along the leaky cable, reflection of a signal occurs at that position, and in conjunction with it, the amount of propagation (the amount of transmission) also changes.

When a crack is present on the leaky cable 201, the amplitude and the phase of the radio wave to be radiated change beyond the cracked point. In addition, when a crack is present on the leaky cable 301, the amplitude and the phase of a signal received beyond the cracked point change; an I-component and a Q-component of a range bin corresponding to the position also vary. In a conventional apparatus that does not adopt the present invention, a fluctuation of a reception signal owing to a crack is erroneously determined as an intrusion object.

For this reason, in the present invention, loci of time-based variation of an I-component and a Q-component of each of the range bins are traced. When a structure of a crack is simple, and the characteristic impedance of the leaky cable changes between two values, an I-component and a Q-component of the range bin corresponding to a position in which the crack is present also vary so as to reciprocate between the two values. In addition, even in a case in which expansions and contractions, or vibrations are added, and variation of the characteristic impedance becomes complex to a certain degree, in many cases, an I-component and a Q-component move back and forth between several points of values at most. Here, because contact and separation owing to a crack of a leaky cable occur instantaneously, movement time between the points each consisting of an I-component and a Q-component is very short. According to the above, when it is detected that an I-component and a Q-component move back and forth between a plurality of points, and that the speed of movements between those points exceeds a predetermined threshold value, it is determined that an electric field fluctuation by a crack is present, so that it is possible to prevent an erroneous determination described above.

Figure 8:
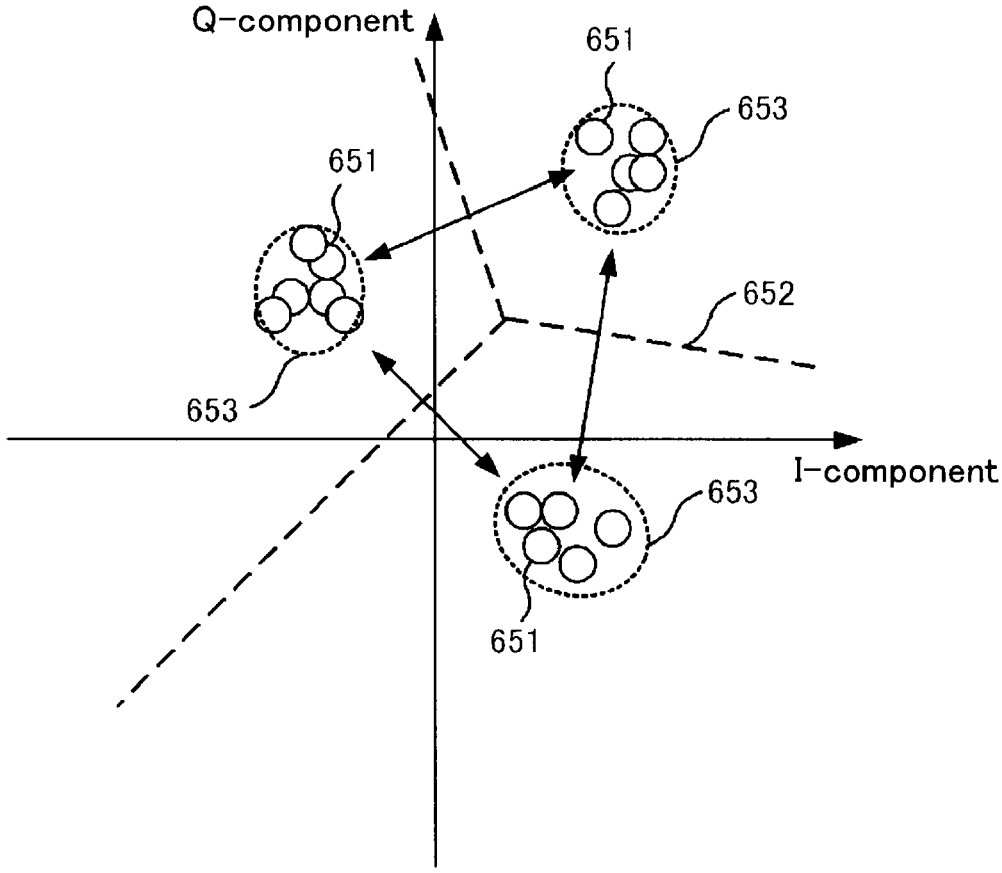
FIG. 8 is a diagram for explaining operating principles of crack detection in Embodiment 1 of the present invention.

As for the determination, various methods may be come up with; thus, by using FIG. 8, an example will be explained. FIG. 8 indicates, defining the horizontal axis as an I-component and the vertical axis as a Q-component, a fluctuation of values of the range bin corresponding to a position of a crack when the crack is caused to the leaky cable.

As for circular marks 651, their I-components and Q-components are indicated on the plane; FIG. 8 shows appearances in which values of an I-component and a Q-component vary, and the values can be broadly classified in three classes and are moving between those three groups as time passes. Minute fluctuations of the values of the I-component and the Q-component demonstrate the fluctuations owing to noise.

By storing current and past I-components and Q-components in the memory 140, the required amounts of I-components and Q-components are extracted retroactively from the current to past ones. Next, class separation generally used in statistical processing is used. Boundaries formed in lines according to the class separation are boundary lines 652. As for the classification calculation, general statistical processing such as the K-unit method or hierarchical clustering can be used. By statistical processing, a mean value and a covariance value are obtained for each of the classified classes. By obtaining eigenvalues from the covariance values, it is possible to extract distribution domains 653 that are domains including the respective classes thereinside.

In a case in FIG. 8, three distribution domains 653 are made. By determining distances between these three distribution domains based on a predetermined threshold value, it can be known that I-components and Q-components are distributed in the plurality of distribution domains 653.

Here, because an I-component and a Q-component of a range bin are basically voltages each, the term "a distance" here corresponds actually to a difference in voltages. In order to obtain the distance between the distribution domains 653, for example, standard deviations of classes are subtracted from the interval between the mean points of the classes, which results in the distance between the distribution domains 653.

In addition, because values of each of the circular marks 651 are stored in a time period at which the correlators 130 output values of an I-component and a Q-component, when the distance between the distribution domains 653 is large, it indicates that a mean value of speeds in which the values of an I-component and a Q-component fluctuate is large, so that it is possible to determine that a crack is present at the position corresponding to the range bin.

As described above, the crack detection unit 155 obtains the distribution domains 653 of I-components and Q-components for each of the range bins, and determines whether the distance between the distribution domains 653 is a predetermined threshold value or more. And, when the distance between the distribution domains 653 is the threshold value or more, the number of the range bin is outputted as crack information. According to a configuration such as this, it becomes possible to determine a crack of the leaky cable without erroneously determining it as an intrusion object.

Figure 9:
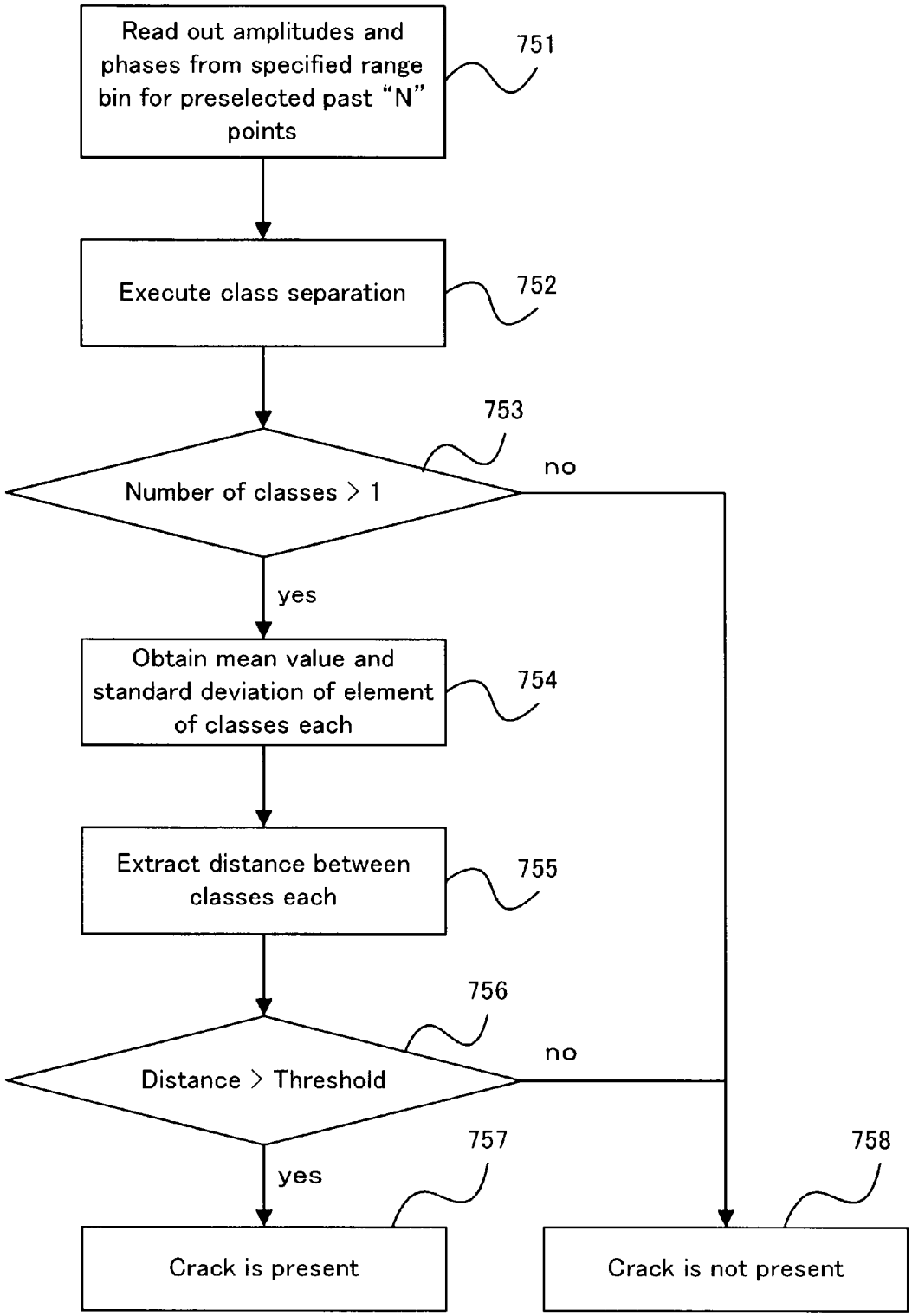
FIG. 9 is a flowchart for explaining the operations of a crack detection unit in the present invention.

Using a flowchart in FIG. 9, the operations of the crack detection unit 155 will be explained.

First, the number of range bins to be checked is specified so as to start. In Block 751, I-components and Q-components of a specified range bin are read out from the memory 140 for preselected past "N" points, and the amplitude and the phase are individually derived for each point.

Next, in Block 752, class separation is executed. As for the classification calculation, general statistical processing such as the K-unit method or hierarchical clustering can be used. Subsequently, the number of classified classes is determined in Block 753; in a case in which the number of classes is greater than one, Block 754 ensues, in other cases, Block 758 ensues.

In Block 754, a mean value and a standard deviation of each class are obtained; and in Block 755, a distance between the distribution domains for each of the classes is extracted.

The distance between the distribution domains obtained is determined in Block 756 so that, when it exceeds a predetermined threshold value, Block 757 ensues, when it does not exceed, Block 758 ensues. The predetermined threshold value is obtained in advance by experiment.

In Block 757, determination is performed as "a crack is present" so as to end; in Block 758, determination is performed as "a crack is not present" so as to end. When determination is performed as "a crack is present," it indicates that an influence of the crack is exerted on the range bin having been examined.

As described above, by examining the range bins one after another from the beginning, it can be known that a crack of the leaky cable is present at a location corresponding to the range bin in which it is first determined as "a crack is present." In addition, by determining all the range bins by this method, it can be known that, even when it is determined as "an intrusion object is present" by the intrusion-object distinguishing unit 151, it is known that the intrusion object is not present when it has been determined as "a crack is present" with respect to the range bin indicated in intrusion object information.

Here, a case will be explained when intrusion occurs at a place where a crack is present.

In a state in which values of an I-component and a Q-component move back and forth among a plurality of distribution domains owing to the crack, when intrusion occurs at a position in which the crack is present, covariance values of the I-components and Q-components of the corresponding range bins become large, and the distribution domains are widened. For this reason, a distance between the distribution domains is narrowed resulting in falling below a threshold value, so that there is a possibility in which it is not determined to be a crack. In such a case described above, it can be determined to be an intrusion object from the amount of fluctuations of the amplitude and the phase. In addition, when a fluctuation owing to the intrusion object is large, class separation cannot be performed, so that there may be a possibility in which it is not determined to be a crack. Namely, even if intrusion occurs at the place in which a crack is present, it is possible to normally detect the intrusion object.

Note that, as described above, an intrusion object is present at a place in which a crack is present, there may be a possibility in which it is not determined to be a crack; however, because it has been once determined to be a crack, by combining with the previous information, it is possible to accurately determine the situation.

As described above, the intrusion-object distinguishing unit 151, the malfunction distinguishing unit 152, the malfunction-range measurement unit 153, the breakage detection unit 154, and the crack detection unit 155 each determine the presence or absence of an intrusion object, and information of a malfunction such as breakage or a crack; the respective information is written into the memory 140.

A determination-result display unit 156 determines display contents based on those determination results, and displays on the display device 400.

For example, intrusion-object information and malfunction information may be individually displayed on the display device 400; however, by comprehensively determining both the intrusion-object information and the malfunction information, it is possible for monitoring personnel to mitigate a workload.

A case in which both of the intrusion-object information and malfunction information are outputted corresponds to a case, for example, when the leaky cable is cut off by an intrusion object. Immediately before the cutoff, the intrusion object is detected and next, malfunction information is outputted owing to the breakage.

According to this Embodiment 1, by using a correlation characteristic of a PN code, an I-component and a Q-component of each range bin are extracted; on the basis of these, the amplitude of each range bin is calculated. And, based on the obtained amplitude, it is possible to detect presence of an intrusion object and a malfunction of the leaky cable.

As a unit to extract an I-component and a Q-component of each range bin, a unit other than a usage of the PN code are conceivable; however, by using a PN code that is a signal whose bandwidth is broad so that electric power per unit band can be made small, transmission signal power per unit frequency can be curbed low. In addition, mutual interference can be curbed low between intrusion-object detection systems.

It is an important point that the mutual interference can be lowered; when a plurality of intrusion-object detection systems is placed closely to the extent that their radio waves reach the other system, interference occurs owing to the mutual radio waves; however, it is possible to lower the mutual interference by using different code sequences for the PN codes. When the mutual interference occurs, there is a case in which the signals are cancelling out each other owing to the relation of signal phases.

For example, when the degree of mutual interference changes because of changes in a reflection coefficient of the ground or a wall by rain or the like so that the signals are cancelling out each other, levels of reception signals decrease in the same manner when a malfunction occurs on the leaky cable. Namely, there is a risk in which an influence by the rain may be erroneously determined as a malfunction of the leaky cable. However, by using a PN code, it becomes possible to cut down on such erroneous determination.

A large reduction of the level owing to such radio-wave interference described above occurs in a specific frequency in which the phases are cancelled out. When the PN code is used, measurement is carried out across a wide frequency band; therefore, when the level is reduced in a portion of frequency band, there is no problem in the overall frequency band; for this reason, it becomes possible to cut down on the erroneous determination.

In addition, by the malfunction-range measurement unit 153, a range is investigated in which changes in a reception signal are caused by damage to a leaky cable. This determination method also leads to prevention of an erroneous determination caused by amplitude reduction owing to mutual interference between intrusion-object detection systems. For example, even when only one intrusion-object detection system is provided, interference also occurs by multipath owing to reflections or the like by the ground or a wall. The reduction of the signal level to a certain extent occurs by the interference, which is not avoidable. However, by investigating a range in which reduction of the signal level occurs, it is possible to obtain clear evidence of damage to a cable. This is because interference owing to such reflections by the ground or a wall only occurs partially.

Moreover, according to the breakage detection unit 154, not only reduction of the signal level, but also a phenomenon in which the signal level is increased that appears at a position corresponding to a range bin in a boundary, on the side to the sensor 100, of a range in which the signal level is reduced are used altogether as determination criteria; therefore, it is possible to provide a determination result with higher accuracy.

As described above, because the detection accuracy is high, a threshold value used to determine a malfunction of a cable can be set high, so that it becomes possible to enhance cable-damage detection capabilities.

In addition, according to the crack detection unit 155, when a crack is caused to the leaky cable, without erroneously determining a fluctuation of a reception signal owing to the crack caused thereto, as an intrusion object, it is possible to detect the crack. A most important effect is that, when a level of the damage is light and detection of the intrusion object can be performed at the same time, it is possible to detect the intrusion object in addition to detection of the damage itself and without being misled by the damage.

Note that, the malfunction-range measurement unit 153 and the breakage detection unit 154 use information of the amplitude or the like that can be obtained from an I-component and a Q-component; by configuring the system in such a way that the information such as the amplitude and the phase calculated by the malfunction distinguishing unit 152 is stored in a memory so as to be read out therefrom, efficiency of processing will be enhanced.

Furthermore, in Embodiment 1, an example is shown using LCXs as the leaky cable 201 and the leaky cable 301; however, not limited to the LCXs, but even using an array antenna in which a plurality of transmission points are formed on a cable and a radio wave is radiated along the cable, the system may be similarly configured.

Embodiment 2

In Embodiment 2, detection unit are shown which are different from various kinds of the detection unit described in Embodiment 1.

Figure 10:
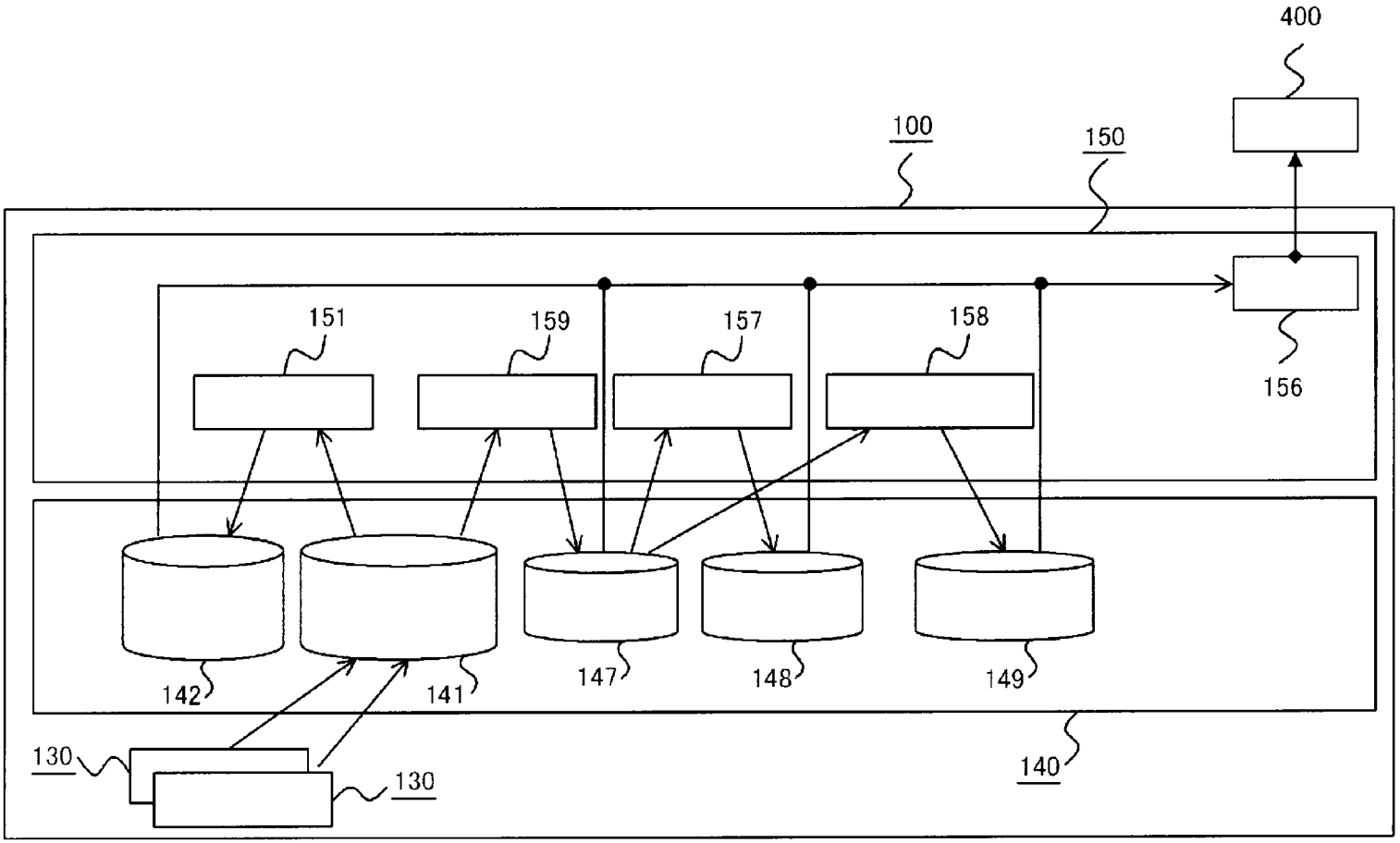
FIG. 10 is a block diagram illustrating a configuration of the functions in Embodiment 2 of the present invention.

By a crack immediate-report unit 157 shown in FIG. 10, abnormality caused by a crack and a distortion to a cable is detected. In addition, an intrusion-object immediate-report unit 158 performs detection of an intrusion object without being influenced by the crack.

Figure 11:
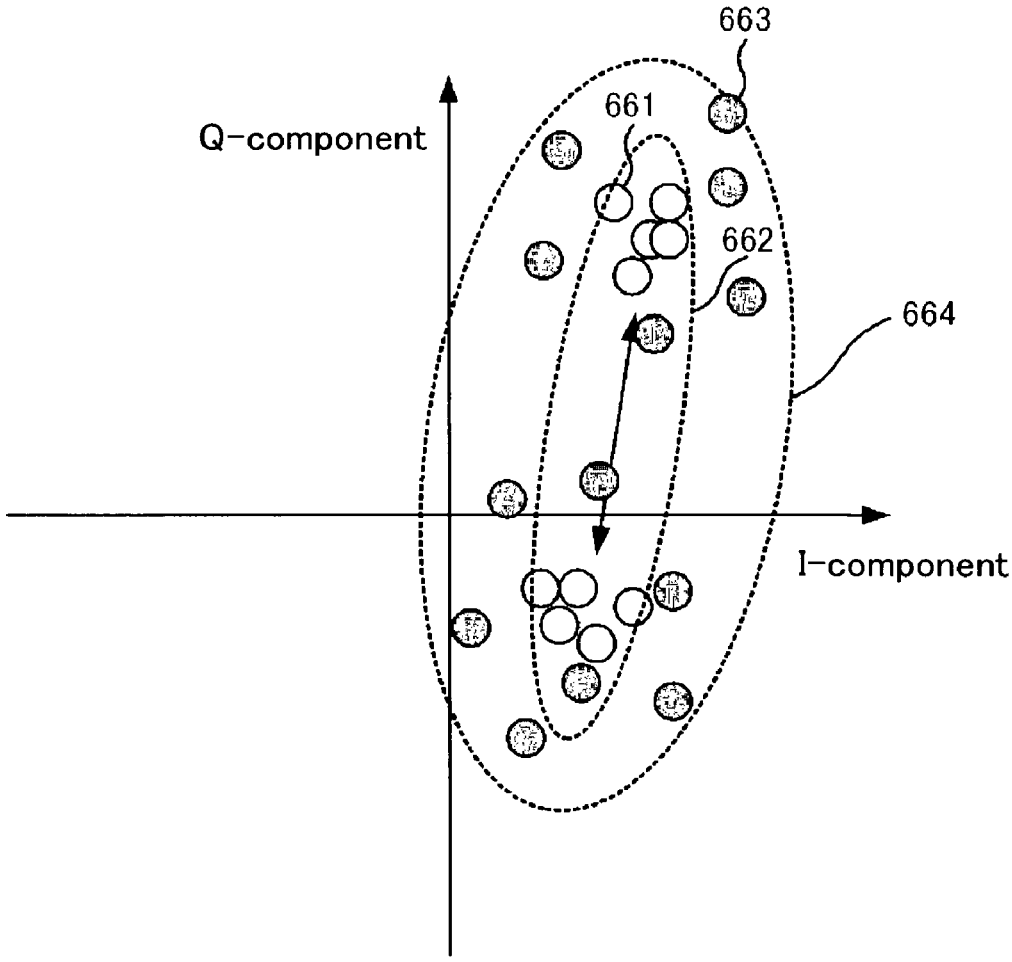
FIG. 11 is a diagram for explaining basic operating principles in Embodiment 2 of the present invention.

The operations in Embodiment 2 will be explained by using FIG. 11. In FIG. 11, values of an I-component and a Q-component are graphed for a range bin in a time series. White circles 661 indicate a situation in which a crack of the leaky cable is present at a position corresponding to the range bin of interest, and values of the range bin move back and forth between two classes. A distribution area of those white circles 661 is indicated by an ellipse 662.

In this state, when an intrusion object is present at a position corresponding to the range bin of interest, values of the range bin vary. Those varying values are indicated by black circles 663. An overall distribution including those black circles 663 and the earlier-mentioned white circles 661 combined is indicated by the ellipse 664.

By extracting a shape of the ellipse 664 in the overall distribution, and by determining the magnitude of the long radius of the ellipse 664 based on a preselected threshold value, extraction of the reciprocating phenomenon between the two classes, namely, detection of a crack can be performed. As for the long radius of the ellipse 664, it is possible to adopt a larger value selected from two eigenvalues having been obtained by solving a covariance matrix of the I-components and Q-components for its eigenvalues.

Next, intrusion detection when the intrusion object is present at a place in which a crack is present will be explained.

When intrusion occurs at the place in which the crack is present, the intrusion detection can be carried out, by using a smaller value selected from the two eigenvalues having been obtained, to determine by a preselected threshold value. In a case of reciprocating between the two classes owing to a crack, a short radius does not become large as shown by the ellipse 662; however, only when the intrusion object is present, the boundary is widened, so that the short radius becomes large as the ellipse 664.

Because a phenomenon in which a short radius of the ellipse 664 becomes large similarly occurs even when the intrusion object is present at a place in which a crack is not present, the intrusion-object immediate-report unit 158 detects the intrusion object by using a smaller value among the eigenvalues having been obtained.

The method of Embodiment 2 cannot be applied to a case of the movement between three classes or more as in Embodiment 1; only a case of reciprocating between two classes can be processed to advantage. However, in comparison to Embodiment 1, the processing is simpler and faster. By adopting a method of laying the leaky cable, when an I-component and a Q-component do not show complex behavior owing to a crack, but show only reciprocating movement between two classes, Embodiment 2 provides a simple and fast method.

As shown in FIG. 10, the crack immediate-report unit 157 and the intrusion-object immediate-report unit 158 output, by using eigenvalue information 147 calculated by an eigenvalue calculation unit 159 from an I-component and a Q-component in the quadrature detection result 151, crack immediate-report information 148 and intrusion-object immediate-report information 149, respectively.

By using flowcharts in FIG. 12, FIG. 13 and FIG. 14, the operations of the eigenvalue calculation unit 159, the crack immediate-report unit 157 and the intrusion-object immediate-report unit 158 will be explained.

Figure 12:
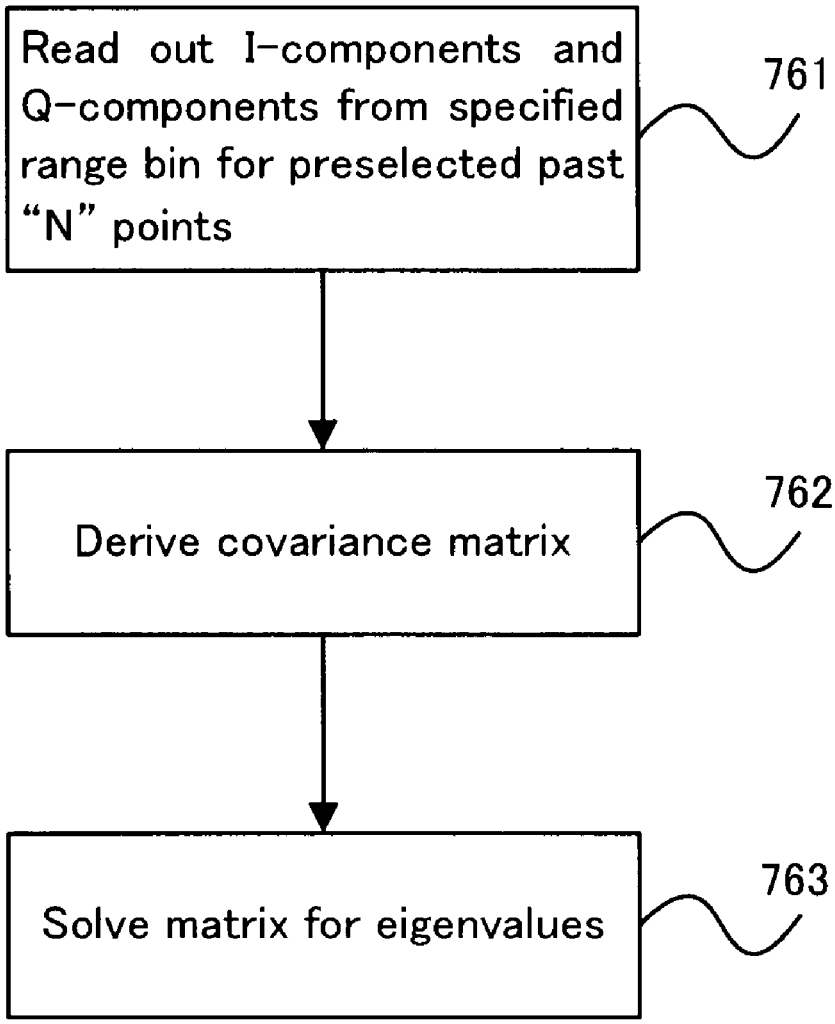
FIG. 12 is a flowchart for explaining the operations of an eigenvalue calculation unit in Embodiment 1 of the present invention.

A flowchart in FIG. 12 shows the operations of the eigenvalue calculation unit 159; first, the number of range bin to be checked is specified so as to start.

In Block 761, I-components and Q-components of a range bin specified from the memory 140 are read out for preselected past "N" points; and in Block 762, a covariance matrix of two rows and two columns is derived.

Next, in Block 763, eigenvalues of the covariance matrix are solved, and between two eigenvalues having been obtained, a larger eigenvalue is given as an eigenvalue 1, a smaller eigenvalue, as an eigenvalue 2.

Because the eigenvalue 1 corresponds to the long radius of the ellipse 664, and the eigenvalue 2, the short radius of the ellipse 664, when the eigenvalue 1 is large, it causes a state in which only the long radius is outstandingly large; it causes a state in which the white circles 661 explained earlier are only distributed. Namely, it can be found that the range bin includes a signal owing to a crack. For example, by examining the range bins from the beginning, it can be found that a crack is caused to the leaky cable in a position corresponding to the range bin at which the long radius first exceeds a threshold value.

Figure 13:
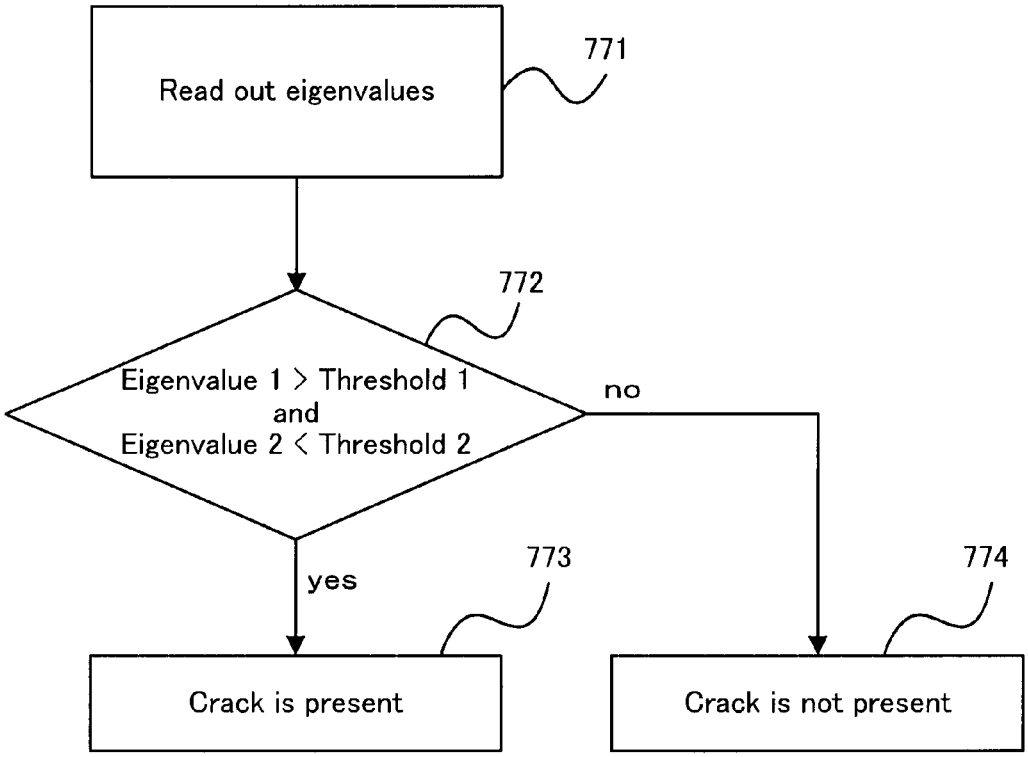
FIG. 13 is a flowchart for explaining the operations of a crack immediate-report unit in Embodiment 1 of the present invention.

The crack immediate-report unit 157 performs the operations described above, and the contents thereof are shown in a flowchart of FIG. 13.

In Block 771, an eigenvalue 1 and an eigenvalue 2 calculated by the eigenvalue calculation unit 159 are read out.

Next, in Block 772, the eigenvalue 1 and the eigenvalue 2 are determined; thereby, with respect to predetermined threshold values 1 and 2, when the conditions of the eigenvalue 1> the threshold value 1, and the eigenvalue 2< the threshold value 2 are held, Block 773 ensues, and when not held, Block 774 ensues. The predetermined threshold values 1 and 2 are obtained in advance by experiment.

In Block 773, it is determined that "a crack is present" as crack immediate-report information so as to end; in Block 774, it is determined that "a crack is not present" as the crack immediate-report information so as to end.

Figure 14:
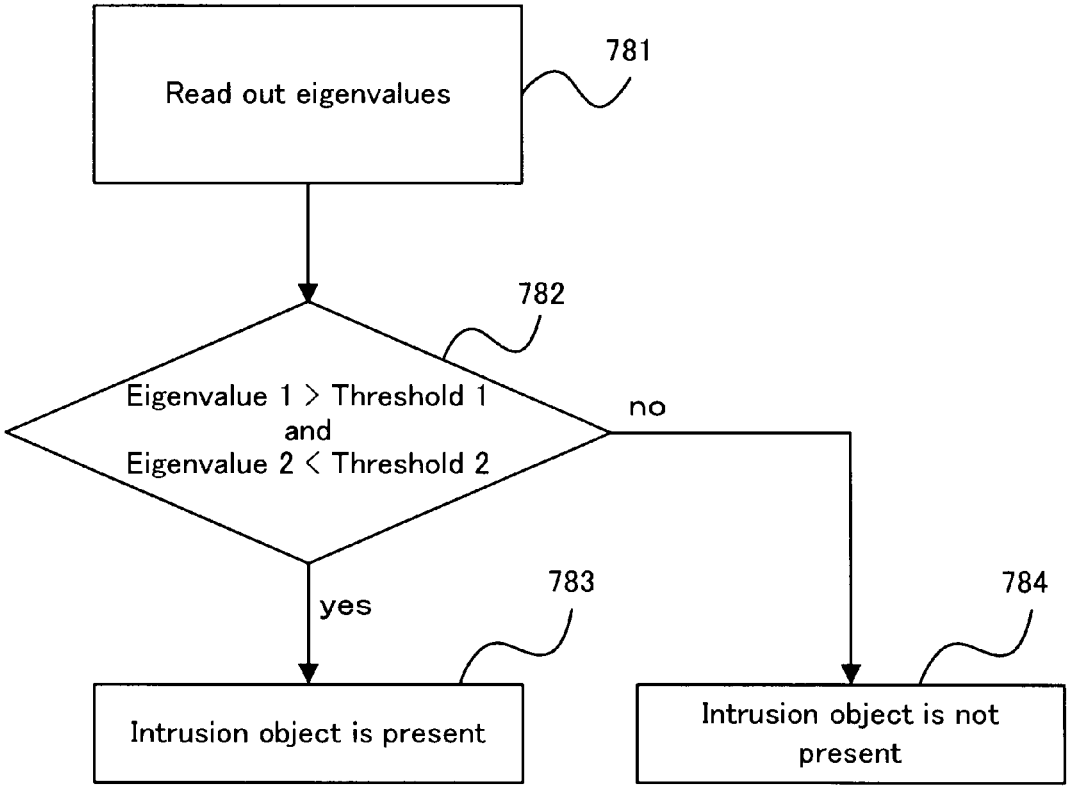
FIG. 14 is a flowchart for explaining the operations of an intrusion-object immediate-report unit in Embodiment 1 of the present invention.

The operations of the intrusion-object immediate-report unit 158 are shown in the flowchart in FIG. 14.

Next, in Block 782, determination of the eigenvalue 1 and the eigenvalue 2 is carried out; with respect to predetermined threshold values 1 and 2, when the conditions of the eigenvalue 1 > the threshold value 1, and the eigenvalue 2 > the threshold value 2 are held, Block 783 ensues, and when not held, Block 784 ensues. The predetermined threshold values 1 and 2 are obtained in advance by experiment.

In Block 783, it is determined that "an intrusion object is present" as an intrusion-object immediate-report so as to end; in Block 784, it is determined that "an intrusion object is not present" as the intrusion-object immediate-report so as to end.

By the operations described above, the state in which the black circles 663 are distributed is determined. By checking all the range bins as described above, it can be found that the intrusion object is present at a position of the leaky cable corresponding to the range bin in which the determination has been carried out as "the intrusion object is present."

According to this Embodiment 2, in comparison to Embodiment 1, it is possible to detect a crack by a more convenient method. In addition, it becomes possible to perform detection of an intrusion object without being influenced by the crack. Because the method is convenient, miniaturization of an apparatus can be achieved, so that it becomes possible to perform detection processing by a CPU that is not very fast.

Embodiment 3

Figure 15:
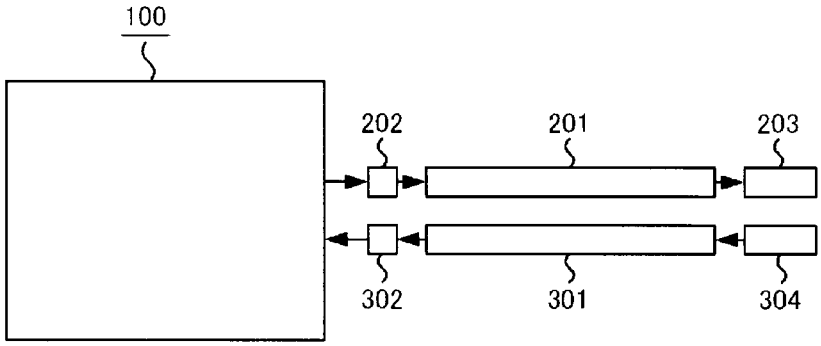
FIG. 15 is a block diagram showing a configuration of an apparatus in Embodiment 3 of the present invention.

A basic configuration in Embodiment 3 is the same as that in Embodiment 1; however, different points will be explained in FIG. 15. FIG. 15 is a block diagram in Embodiment 3. In the configuration of an apparatus, the different points are that, in place of the terminator 303, a reflector 304 is connected at the termination end of the leaky cable 301.

By connecting the reflector 304 thereat, it is possible to determine on which of the leaky cable 201 and the leaky cable 301 a malfunction has occurred.

By using FIG. 16 and FIG. 17, the operations of receiving-side malfunction detection will be explained.

Figure 16:
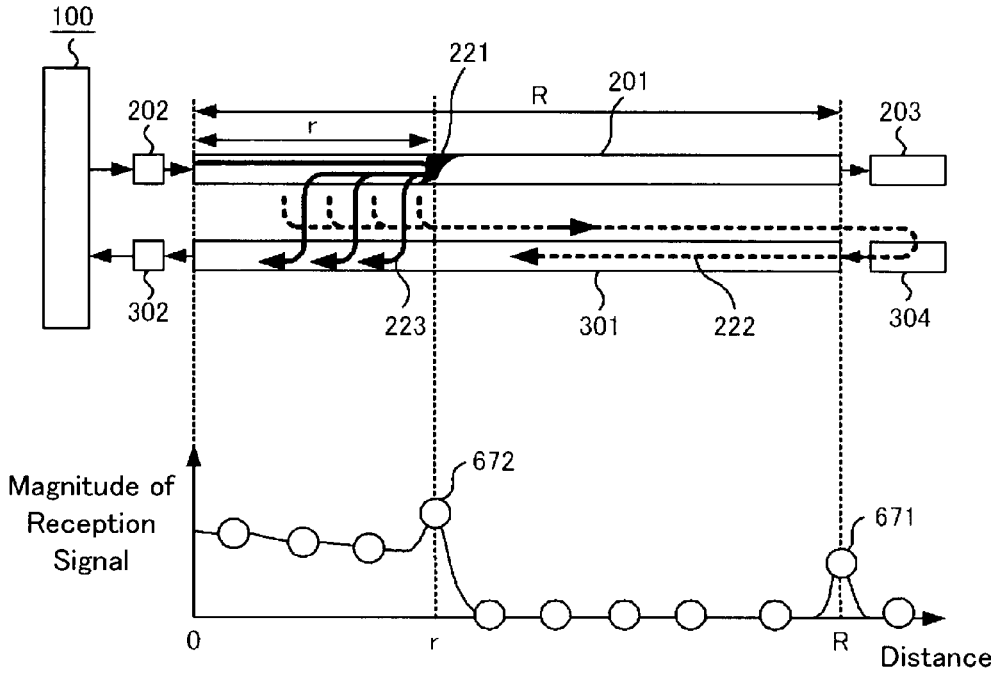
FIG. 16 is a diagram for explaining operating principles in Embodiment 3 of the present invention.

FIG. 16 is a diagram for explaining the operations in Embodiment 3 in a case in which a breakage point 221 is present in the leaky cable 201. In addition to the phenomena explained in FIG. 5 described in Embodiment 1, signal paths 222 are added as signal's transmission paths owing to the action by the reflector 304. As for a reception signal along the signal paths 222, a peak appears in a range bin 671 corresponding to a position of the reflector 304.

Figure 17:
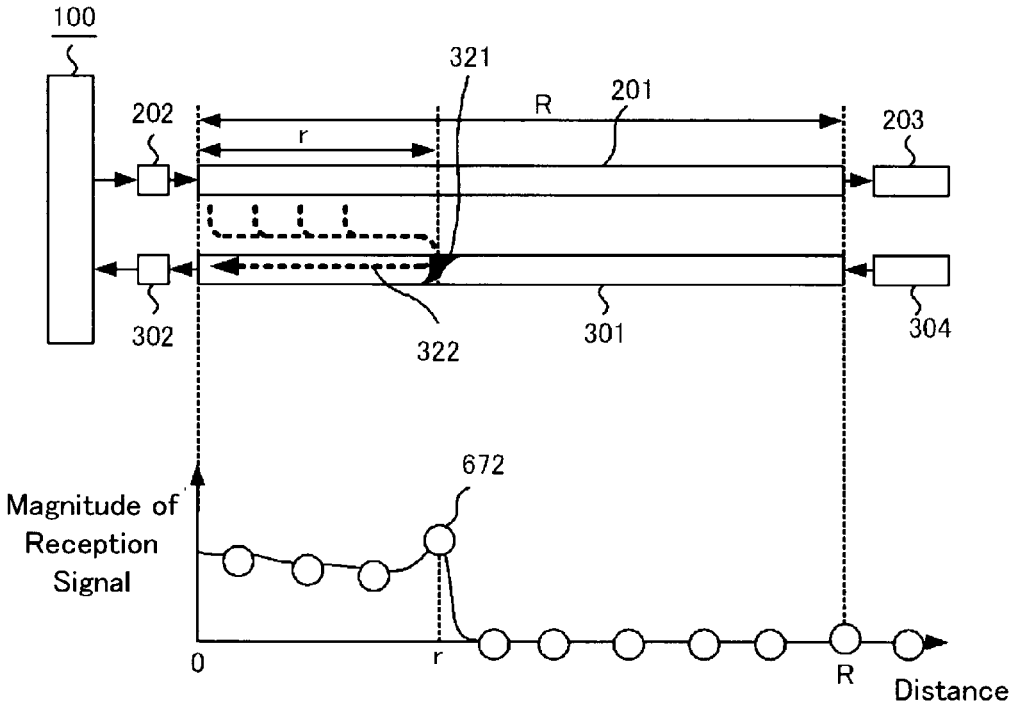
FIG. 17 is another diagram for explaining the operating principles in Embodiment 3 of the present invention.

On the other hand, FIG. 17 is a diagram explaining the operations in Embodiment 3, when a breakage point 321 is present on the leaky cable 301. In this case, such signal paths 222 do not exist; thus, a peak does not appear in the range bin 671.

Consequently, after having found a damaged place by the method explained in Embodiment 1, by determining a value for the range bin 671 corresponding to a position of the reflector 304 based on a threshold value predetermined by experiment, it is possible to distinguish which of the leaky cable 201 or the leaky cable 301 has been damaged. If a peak is present in the range bin 671, it can be determined that the breakage point 221 is present on the leaky cable 201; if a peak is not present in the range bin 671, it can be determined that the breakage point 321 is present on the leaky cable 301.

Figure 18:
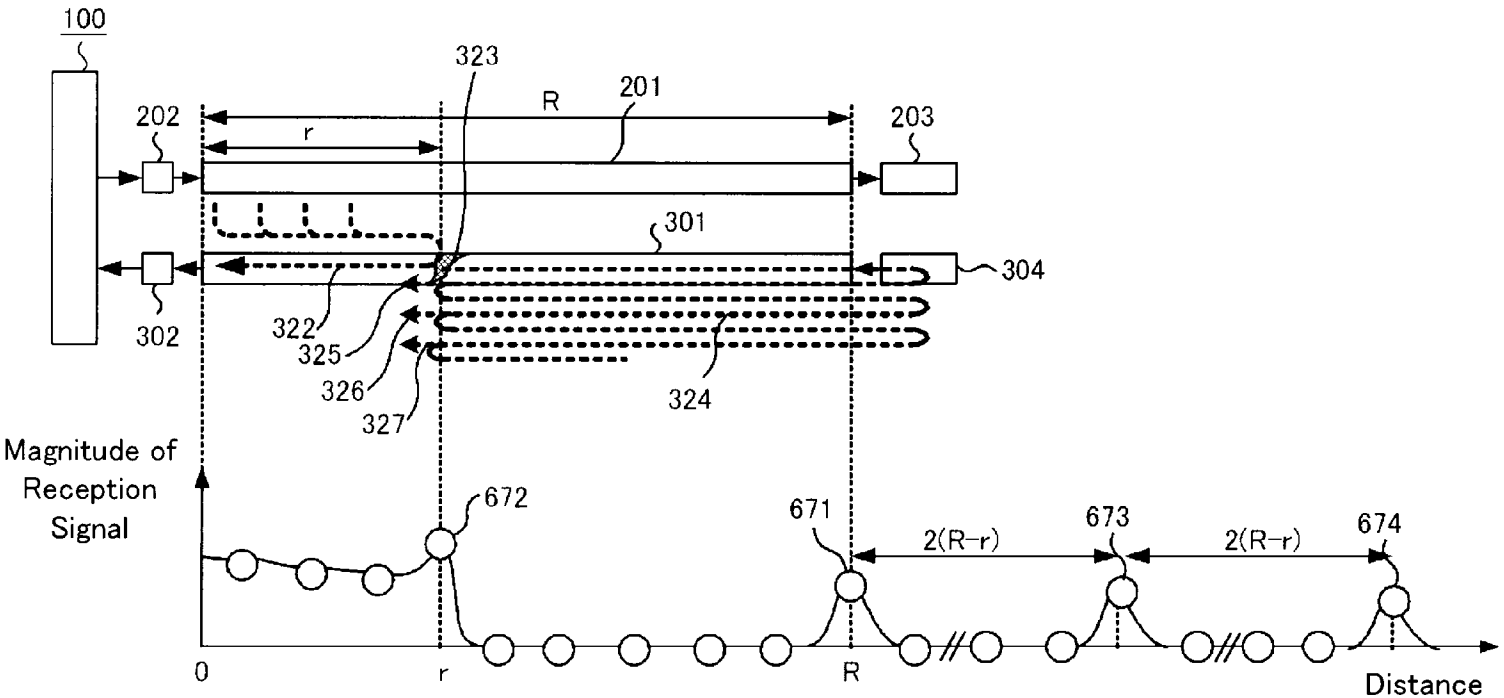
FIG. 18 is yet another diagram for explaining the operating principles in Embodiment 3 of the present invention.

However, when not breakage but a crack is present in the leaky cable, not all the signals are interrupted at a damaged place, but part of them is transmitted, resulting in different operations. A manner for distinguishing this case will be explained using FIG. 18. FIG. 18 is a diagram explaining the operations of a case in which a crack 323 is present on the leaky cable 301 in Embodiment 3.

When the crack 323 is present on the leaky cable, the characteristic impedance changes at that part; therefore, part of a signal is reflected. Basically, the phenomena explained in Embodiment 1 occur; however, in addition to those, a signal is generated that reciprocates by reflection, for example along signal paths 324, between the reflector 304 and the crack 323. Part of the signal is inputted into the sensor 100 as a leakage signal 325, a leakage signal 326 and a leakage signal 327.

In the sensor 100, the leakage signal 325 is observed in the range bin 671, the leakage signal 326, in the range bin 673, and the leakage signal 327, in the range bin 674, respectively. The range bin 671 corresponds to the position of the reflector 304; given that the length of the leaky cable 301 is "R" and the position of a crack is defined at a position of "r" on the leaky cable 201 from the side of the sensor 100, the interval between the range bin 671 and the range bin 673, and the interval between the range bin 673 and the range bin 674 both are equivalent to a distance of 2(R−r). Actually, peaks appear successively also at positions beyond the range bin 674 in the intervals of 2(R−r).

Namely, although a peak is present in the range bin 671 corresponding to the position of the reflector 304, depending on whether a malfunction is breakage or a crack, a phenomenon whether peaks appear at positions beyond the far end is different.

Based on this operation, a receiving-side malfunction distinguishing unit can be configured similarly to the malfunction distinguishing unit 152, so that receiving-side malfunction information can be outputted.

In addition, because it is possible to determine a position of a crack of the leaky cable 301 on the receiving side based on the intervals of peaks at the positions beyond the far end, a receiving-side crack-position detection unit can be configured similarly to the malfunction-range measurement unit 153 or the like, so that receiving-side crack position information can be outputted. A feature of the receiving-side crack-position detection unit is that it can detect not only a crack of the leaky cable, but also a crack of the coaxial cable 302 and other cracks and looseness of connectors. For example, because a signal reflects even when a crack is present on the coaxial cable 302, the successive peaks described above appear. When looseness is present on a connector, reflections similar to the above also occur. Namely, in Embodiment 3, it becomes possible to carry out not only detection of the leaky cable, but also detection of a crack of a coaxial cable and such a crack and looseness of the connector, and detection of their position by the receiving-side crack-position detection unit.

According to the above, as for the peaks appearing at the range bin 673 and the range bin 674, not only in a case in which the characteristic impedance of a leaky cable changes owing to a crack or the like, but also when a crack is caused to the coaxial cable 302, reflections similar to the above occur. In addition, when a connecting part between the coaxial cable 302 and the leaky cable 301 is not normal, or when a connecting part between the coaxial cable 302 and the sensor 100 is not normal, reflections also occur. For example, there are cases in which the connector is loosened or damaged.

On the other hand, when a crack is caused to the leaky cable 201 or the coaxial cable 202, reflections such as these do not occur; thus, by checking as explained before the presence of successively appearing peaks, it is possible to determine on which side of the transmitting side and the receiving side a crack is caused. When a crack is caused to the leaky cable 201, it is possible to determine the location by the method explained in Embodiment 1.

Note that, in Embodiment 3, although the explanation has been made for a case in which the reflector 304 is mounted on the receiving side, by mounting it on the transmitting side, the detection can be similarly performed on the transmitting side.

According to this Embodiment 3, it is possible to distinguish on which of the transmitting side and the receiving side a crack is caused. When a crack is caused to the leaky cable on the side to which a reflector is mounted, a specific phenomenon occurs; therefore, as a first step, by the methods explained in Embodiment 1 and Embodiment 2, the presence or absence of a crack and its location are detected; as a second step, by examining the presence or absence of the peaks, as explained as a specific phenomenon in this embodiment, that periodically appear in the range bins positioned beyond the termination end of the leaky cable, it can be found that, when they exist, a crack is present on the leaky cable with the reflector connected thereto, when they do not, a crack is present on the leaky cable in which the reflector is not connected thereto.

In addition, on the side in which the reflector is mounted, it is possible to detect a position of damage not only to the leaky cable, but also to a coaxial cable or a connector.

Embodiment 4

Figure 19:
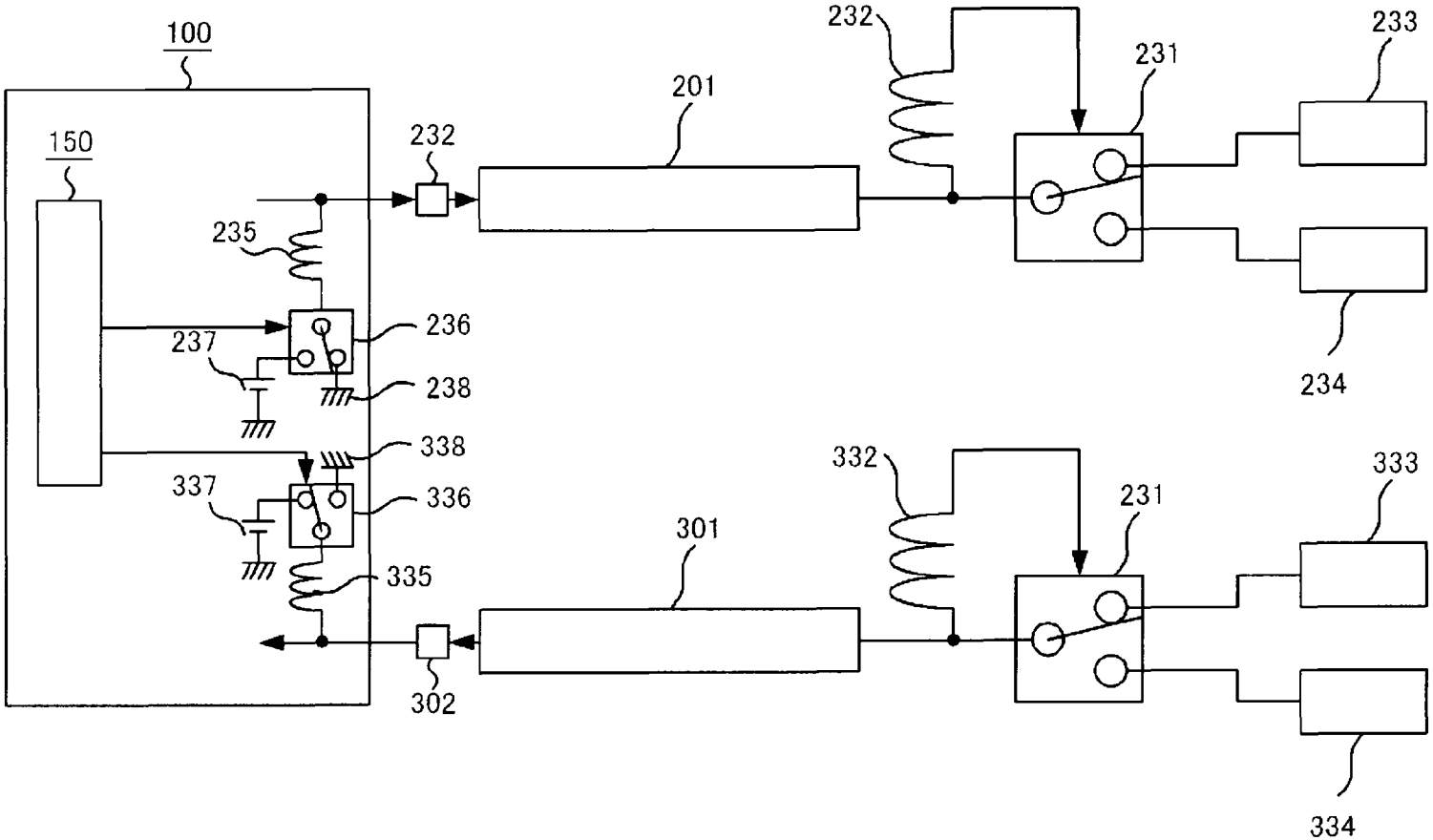
FIG. 19 is a block diagram showing a configuration of an apparatus in Embodiment 4 of the present invention.

In Embodiment 4, by letting Embodiment 1 as a basis, devices explained in FIG. 19 are mounted at both termination ends of the leaky cable 201 and the leaky cable 301. FIG. 19 is a block diagram in Embodiment 5.

In an apparatus explained in FIG. 19, it is so arranged that, by a "changeover unit" such as a changeover switch, it can switch to either a terminator or a reflector. As for a control method of the changeover unit, various methods may be applied; here, a mechanism is adopted so as to control using a DC voltage applied to the leaky cable. For example, it is conventionally possible to supply the DC voltage by interposing a device such as a bias-T that is an AC/DC splitter into a high-frequency signal line, without influencing on the high-frequency signal; thereby, the CPU 150 controls the voltage level, which can be carried out without particularly causing a problem.

Because, similar methods of controlling the changeover unit are used for the transmitting side and the receiving side, a method for the transmitting side is taken as an example to explain below.

The CPU 150 controls a switch 231 by controlling the voltage level of DC voltage applied to the leaky cable 201. A coil 232 is a coil for extracting the DC voltage from an output of the leaky cable 201 without influencing on the high-frequency signal. By changing the switch 231, it is possible to switch the connection of the leaky cable 201 to either a terminator 233 or a reflector 234.

When the DC voltage that is applied to the leaky cable 201 is smaller than a predetermined value, it is so arranged that the reflector 234 is selected. By configuring according to the above, when a malfunction occurs at some point along the leaky cable 201, and the voltage level is reduced, the reflector 234 is automatically selected. However, the CPU 150 usually performs a voltage control.

A coil 235 is a coil for supplying the DC voltage without influencing on the high-frequency signal. A switch 236 is connected to the CPU 150, and performs the voltage control according to the control by the CPU 150. By turning the switch on the side of a voltage source 237, the DC voltage is supplied to the leaky cable 201; by turning it on the side of a GND 238, the DC voltage is not supplied to the leaky cable 201. Therefore, the CPU 150 can switch to either the terminator 233 or the reflector 234 by controlling the switch 236.

As described above, the CPU 150 selects to connect each of the leaky cable 201 and the leaky cable 301 to either a terminator or a reflector; however, the control is taken so as to choose the opposite selection for the leaky cable 201 and the leaky cable 301 with each other. For example, when the reflector 234 is connected to the leaky cable 201, the control is taken so that a terminator 333 is connected to the leaky cable 301. And, observation is carried out whether successive peaks of the range bins explained in Embodiment 3 are present beyond the length of the leaky cable. If the phenomenon as explained in Embodiment 3 occurs, it can be found that abnormality is present on the leaky cable on the side to which the reflector is connected.

In Embodiment 3, because a crack caused to the leaky cable 301 is only explained, here, by using FIG. 20, a crack caused to the leaky cable 201 will be explained; then, the operations to detect and output crack information on the transmitting side will be explained.

Figure 20:
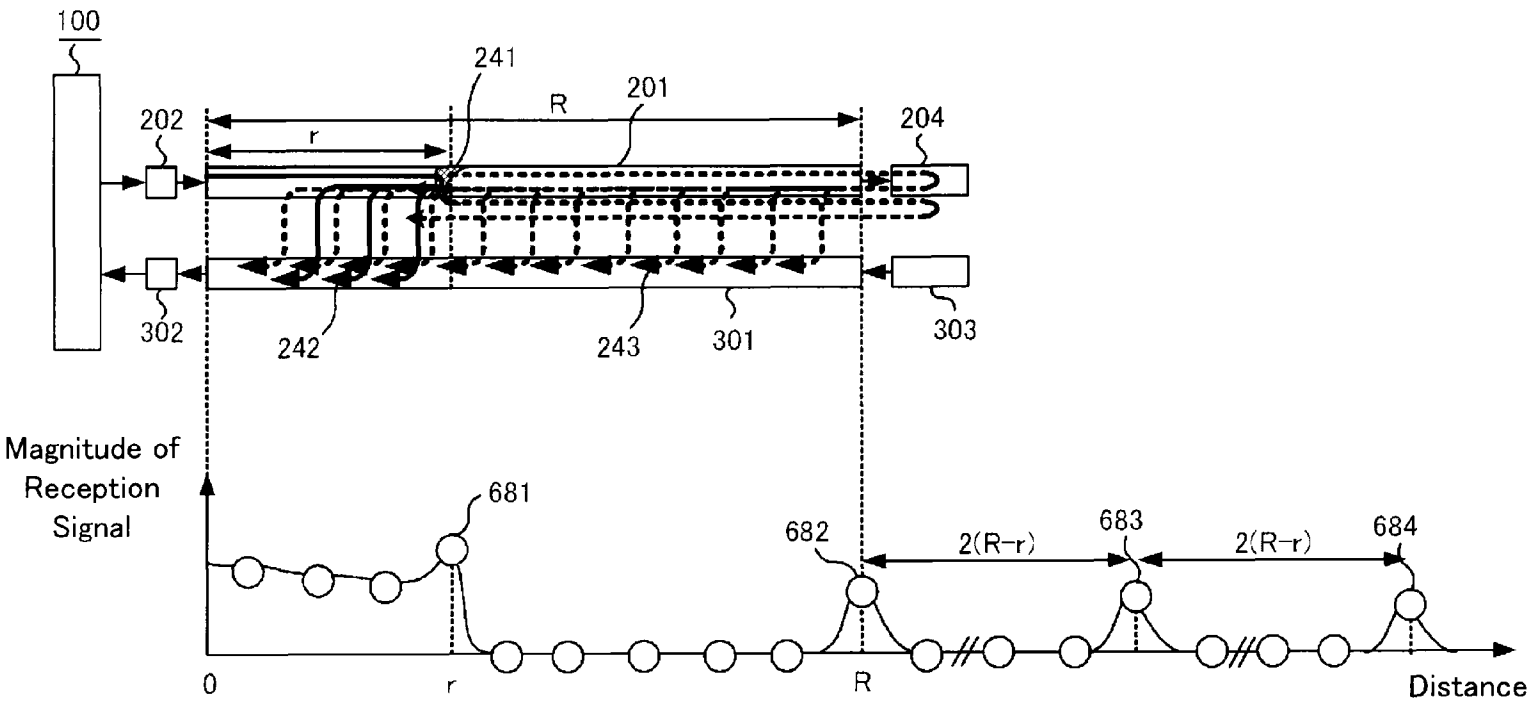
FIG. 20 is a diagram for explaining operating principles in Embodiment 4 of the present invention.

In FIG. 20, the changeover unit explained in this embodiment are omitted for brevity; therefore, a reflector 204 connected to the leaky cable 201 is not connected to the changeover unit; however, the state is the same that the reflector 234 is selected by the "changeover unit." In addition, the same applies to the terminator 303 that is connected to the leaky cable 301.

Owing to a crack 241 caused to the leaky cable 201, signal paths 242 and signal paths 243 are established. The signal paths 242 are the paths along which a signal reflected by the crack 241 is radiated, received by the leaky cable 301, and returning to the sensor 100. The signal paths 243 are the paths along which a signal repeatedly reflected by the crack 241 and the reflector 204 is gradually received by the leaky cable 301, and returning to the sensor 100.

A signal that passes along those signal paths 242 and signal paths 243 is observed by the sensor 100 as a plurality of peaks of range bins. A peak appearing at a range bin 681 is caused by a signal reflected by the crack 241. A peak appearing at a range bin 682 is caused by a signal that has passed through the crack 241 and once reflected by the reflector 204. A peak appearing at a range bin 683 is caused by a signal in which a signal reflected by the reflector 204 has been reflected by the crack 241 and reflected by the reflector 204 for the second time.

As described above, basic principles of the peaks appearing at the range bins are the same as the principles explained in Embodiment 3 in which the crack 321 is produced on the leaky cable 301; by detecting and analyzing the peaks, a position of the crack 241 on the leaky cable 201 can be known.

Namely, it is possible to actualize a transmitting-side crack information detection unit by the operations similar to a receiving-side crack information detection unit.

Similarly, based on the same principle as the receiving-side crack-position detection unit, it is possible to configure a transmitting-side crack-position detection unit, so that transmitting-side crack-position information can be outputted.

In Embodiment 4, by changing over a switch 236 and a switch 336, observation is carried out whether successive peaks of the range bins are present at the positions beyond the length "R" of the leaky cables. When the terminator 233 is selected for the leaky cable 201, and a reflector 334 is selected for the leaky cable 301, if successive peaks of the range bins are present, receiving-side crack information is outputted. On the other hand, when the reflector 234 is selected for the leaky cable 201, and the terminator 333 is selected for the leaky cable 301, if successive peaks of the range bins are present, transmitting-side crack information is outputted.

In addition, similarly to the manners as set forth in Embodiment 3, it is possible to detect not only a crack of the leaky cable, but also a crack of a coaxial cable, and a crack and looseness of a connector.

According to this Embodiment 4, it is possible to detect on which side of the transmitting side and the receiving side cable's breakage or a crack is caused and where the location is. Moreover, a damaged place of a coaxial cable or a connector can also be detected.

Note that, as for the "changeover unit," an example is shown in which the DC voltage is used to apply to the leaky cable; however, other than this, various methods such as control using radio can be applied to the control of the "changeover unit."

Embodiment 5

In Embodiment 1 through Embodiment 4, by using a PN code, the amplitude and the phase of a reception signal are measured for each of the range bins; however, other methods can be used as long as the reception signal with respect to the "distance" can be measured. For example, a frequency-modulated continuous-wave method (hereinafter referred to as FM-CW) may be used in which a chirp signal is transmitted, and a reception signal with respect to the "distance" is outputted after performing the Fourier transform on a beat signal that is obtained by mixing a reception signal and a transmission signal.

Figure 21:
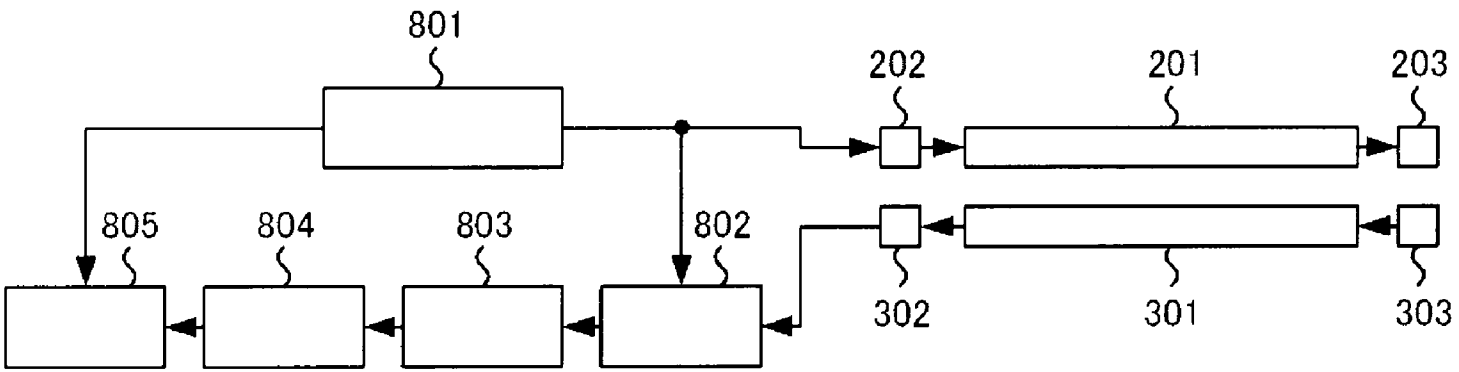
FIG. 21 is a block diagram illustrating a configuration of the functions in Embodiment 5 of the present invention.

A configuration in Embodiment 5 is shown in FIG. 21.

A chirp signal generator 801 outputs a chirp signal whose frequency continuously changes in the range from a frequency "F1" to a frequency "F2" to the coaxial cable 202 and a multiplier 802. The signal inputted into the coaxial cable 202 is radiated into space from the leaky cable 201 as a radio wave; the radiated radio wave is received by the leaky cable 301. The reception signal received by the leaky cable 301 passes through the coaxial cable 302, and is inputted into the multiplier 802. A beat signal in a low frequency is extracted from an output of the multiplier 802 by a filter 803, and further converted by an A/D converter 804 into a digital signal, which is sent into a CPU 805. The CPU 805 stores the beat signal for a predetermined time, in synchronization with output timing of a chirp signal outputted from the chirp signal generator 801. And, by performing the Fourier transform on the stored beat signal, the real part and the imaginary part for each frequency are extracted as an I-component and a Q-component, respectively.

Note that, if the beat signal is stored by the CPU 805 without being synchronized with the output timing of the chirp signal, the phases will be shifted, so that the I-component and the Q-component cannot be determined.

The output obtained by performing the Fourier transform on the beat signal is a frequency spectrum; however, in the RM-CW method, the frequency axis corresponds to the "distance" direction, and frequencies each can be handled as range bins. Values of the real part and the imaginary part after the Fourier transform correspond to an I-component and a Q-component for each of range bins, respectively.

After the I-components and Q-components have been obtained, an intrusion object and damage to the cables can be detected by the methods explained in Embodiment 1 through Embodiment 4.

The chirp signal explained in Embodiment 5 is a signal whose frequency continuously changes in the range from a frequency "F1" to a frequency "F2"; however, by broadening the frequency range between "F1" and "F2," it is possible to accomplish high resolution with ease. Therefore, in comparison to the method that aims at high resolution using a PN code explained in Embodiment 1, a method in Embodiment 5 is easier to accomplish it. This is because, if the method using a PN code is applied to accomplish high resolution, the code rate of a PN code is required to be increased, and digital signal processing must be executed fast.

Note that, an effect to avoid mutual interference between intrusion-object detection systems explained in Embodiment 1 is also effective in the FM-CW method in Embodiment 5. When a plurality of intrusion-object detection systems are distanced to the extent that their radio waves reach each other and output timings of their chirp signals are very close to each other, very strong interference occurs. At this time, an influence owing to the interference appears at the distance that corresponds to shifted time between their output timings. However, because the distance range is partial, by investigating a range in which a signal level is reduced, it is possible to avoid an erroneous determination.

What is claimed is:

1. An intrusion-object detection system, comprising:

a radio-wave radiation unit, in a cable form with one end thereof as a feed end and the other end thereof as a far end, configured to radiate as a radio wave, a transmission signal on which a spread spectrum signal is superimposed fed into said radio-wave radiation unit from the feed end;

a radio-wave reception unit configured to receive the radio wave, in a cable form, placed approximately in parallel with said radio-wave radiation unit;

a signal reception unit configured to receive the transmission signal as a reception signal, connected to an end, on the feed-end side, of said radio-wave reception unit;

a signal demodulation unit configured to define the reception signal so as to calculate the amplitude of the reception signal with respect to range bins each correlated with a distance from a position of the feed end, on said radio-wave radiation unit and said radio-wave reception unit, based on a correlation between a time-delay from transmission time of the transmission signal until reception time of the reception signal and the distance along a transmission path according to route's positions on said radio-wave radiation unit and said radio-wave reception unit in the transmission path through which the transmission signal passes after its transmission until reception as the reception signal, by comparing a code sequence of a spread spectrum signal extracted from the reception signal with a code sequence of a spread spectrum signal in the transmission signal; and a malfunction distinguishing unit configured to determine that a malfunction is present in either said radio-wave radiation unit or said radio-wave reception unit, when, comparing the reception signal with the transmission signal for the range bins corresponding to the far end, a level of amplitude reduction in the reception signal exceeds a predetermined ratio.

2. An intrusion-object detection system, comprising:

a radio-wave radiation unit, in a cable form with one end thereof as a feed end, configured to radiate as a radio wave, a transmission signal on which a spread spectrum signal is superimposed being fed into said radio-wave radiation unit from the feed end;

a radio-wave reception unit configured to receive the radio wave, in a cable form, placed approximately in parallel with said radio-wave radiation unit;

a signal reception unit configured to receive the transmission signal as a reception signal, connected to an end, on the feed-end side, of said radio-wave reception unit;

a signal demodulation unit configured to define the reception signal so as to calculate the amplitude of the reception signal with respect to range bins each correlated with a distance from a position of the feed end, on said radio-wave radiation unit and said radio-wave reception unit, based on a correlation between a time-delay from transmission time of the transmission signal until reception time of the reception signal and the distance along a transmission path according to route's positions on said radio-wave radiation unit and said radio-wave reception unit in the transmission path through which the transmission signal passes after its transmission until reception as the reception signal, by comparing a code sequence of a spread spectrum signal extracted from the reception signal with a code sequence of a spread spectrum signal in the transmission signal; and a malfunction-range measurement unit configured to determine, by determining, with respect to each of the range bins, a level of amplitude reduction in the reception signal compared with the transmission signal, and by detecting, out of the range bins in which the level of amplitude reduction exceeds a predetermined ratio, a range bin that corresponds to the nearest position to the feed end, that a malfunction is present in a position corresponding to said range bin related to either said radio-wave radiation unit or said radio-wave reception unit.

3. An intrusion-object detection system, comprising:

a radio-wave radiation unit, in a cable form with one end thereof as a feed end, configured to radiate as a radio wave, a transmission signal on which a spread spectrum signal is superimposed being fed into said radio-wave radiation unit from the feed end;

a radio-wave reception unit configured to receive the radio wave, in a cable form, placed approximately in parallel with said radio-wave radiation unit;

a signal reception unit configured to receive the transmission signal as a reception signal, connected to an end, on the feed-end side, of said radio-wave reception unit;

a signal demodulation unit configured to define the reception signal so as to calculate the amplitude of the reception signal with respect to range bins each correlated with a distance from a position of the feed end, on said radio-wave radiation unit and said radio-wave reception unit, based on a correlation between a time-delay from transmission time of the transmission signal until reception time of the reception signal and the distance along a transmission path according to route's positions on said radio-wave radiation unit and said radio-wave reception unit in the transmission path through which the transmission signal passes after its transmission until reception as the reception signal, by comparing a code sequence of a spread spectrum signal extracted from the reception signal with a code sequence of a spread spectrum signal in the transmission signal; and a breakage detection unit configured to determine, when there exists a range bin among the range bins in which the amplitude of the reception signal is increased in comparison to the transmission signal, that breakage is present in a position corresponding to said range bin related to either said radio-wave radiation unit or said radio-wave reception unit.

4. An intrusion-object detection system, comprising:

a radio-wave radiation unit, in a cable form with one end thereof as a feed end, configured to radiate as a radio wave, a transmission signal on which a spread spectrum signal is superimposed being fed into said radio-wave radiation unit from the feed end;

a signal reception unit configured to receive the transmission signal as a reception signal, connected to an end, on the feed-end side, of a radio-wave reception unit;

a signal demodulation unit configured to define the reception signal so as to calculate a quadrature-detection result by performing quadrature detection on the reception signal with respect to range bins each correlated with a distance from a position of the feed end, on said radio-wave radiation unit and said radio-wave reception unit, based on a correlation between a time-delay from transmission time of the transmission signal until reception time of the reception signal and the distance along a transmission path according to route's positions on said radio-wave radiation unit and said radio-wave reception unit in the transmission path through which the transmission signal passes after its transmission until reception as the reception signal, by comparing a code sequence of a spread spectrum signal extracted from the reception signal with a code sequence of a spread spectrum signal in the transmission signal; and a crack detection unit configured to determine, in a case in which a time-series distribution of the reception signal in a plane coordinated by I-components and Q-components of the quadrature-detection result of the reception signal is classified, when the distribution is classified into a plurality of classes and there exists a range bin among the range bins in which the location of the reception signal moves astride the plurality of classes as time passes, that a crack is present in a position corresponding to said range bin related to either said radio-wave radiation unit or said radio-wave reception unit.

5. An intrusion-object detection system, comprising:

a radio-wave radiation unit, in a cable form with one end thereof as a feed end, configured to radiate as a radio wave, a transmission signal on which a spread spectrum signal is superimposed being fed into said radio-wave radiation unit from the feed end;

a signal reception unit configured to receive the transmission signal as a reception signal, connected to an end, on the feed-end side, of a radio-wave reception unit;

a signal demodulation unit configured to define the reception signal so as to calculate a quadrature-detection result by performing quadrature detection on the reception signal with respect to range bins each correlated with a distance from a position of the feed end, on said radio-wave radiation unit and said radio-wave reception unit, based on a correlation between a time-delay from transmission time of the transmission signal until reception time of the reception signal and the distance along a transmission path according to route's positions on said radio-wave radiation unit and said radio-wave reception unit in the transmission path through which the transmission signal passes after its transmission until reception as the reception signal, by comparing a code sequence of a spread spectrum signal extracted from the reception signal with a code sequence of a spread spectrum signal in the transmission signal; and a crack immediate-report unit configured to determine, when there exists a range bin in which a larger eigenvalue in eigenvalues of a covariance matrix of I-components and Q-components of the quadrature-detection result of the reception signal is greater than a first predetermined value, and a smaller eigenvalue in the eigenvalues, less than a second predetermined value, that a crack is present in a position corresponding to said range bin related to either said radio-wave radiation unit or said radio-wave reception unit.

6. An intrusion-object detection system, comprising:

a radio-wave radiation unit, in a cable form with one end thereof as a feed end, configured to radiate as a radio wave, a transmission signal on which a spread spectrum signal is superimposed being fed into said radio-wave radiation unit from the feed end;

a signal reception unit configured to receive the transmission signal as a reception signal, connected to an end, on the feed-end side, of a radio-wave reception unit;

a signal demodulation unit configured to define the reception signal so as to calculate a quadrature-detection result by performing quadrature detection on the reception signal with respect to range bins each correlated with a distance from a position of the feed end, on said radio-wave radiation unit and said radio-wave reception unit, based on a correlation between a time-delay from transmission time of the transmission signal until reception time of the reception signal and the distance along a transmission path according to route's positions on said radio-wave radiation unit and said radio-wave reception unit in the transmission path through which the transmission signal passes after its transmission until reception as the reception signal, by comparing a code sequence of a spread spectrum signal extracted from the reception signal with a code sequence of a spread spectrum signal in the transmission signal; and an intrusion-object immediate-report unit configured to determine, when there exists range bin in which a larger eigenvalue in eigenvalues of a covariance matrix of I-components and Q-components of the quadrature-detection result of the reception signal is greater than a first predetermined value, and a smaller eigenvalue in the eigenvalues, greater than a second predetermined value, that an intrusion-object is present in a position corresponding to said range bin related to either said radio-wave radiation unit or said radio-wave reception unit.

7. An intrusion-object detection system, comprising:

a radio-wave radiation unit, in a cable form with one end thereof as a feed end and the other end thereof as a far end, configured to radiate as a radio wave, a transmission signal on which a spread spectrum signal is superimposed being fed into said radio-wave radiation unit from the feed end;

a radio-wave reception unit configured to receive the radio wave, in a cable form, placed approximately in parallel with said radio-wave radiation unit;

a terminator configured to absorb the radio wave, connected to the far end of either said radio-wave radiation unit or said radio-wave reception unit;

a reflector configured to reflect the radio wave connected to the far end of either said radio-wave radiation unit or said radio-wave reception unit to which said terminator is not connected;

a signal reception unit configured to receive the transmission signal as a reception signal, connected to an end, on the feed-end side, of said radio-wave reception unit;

a signal demodulation unit configured to define the reception signal so as to calculate the amplitude of the reception signal with respect to range bins each correlated with a distance from a position of the feed end, on said radio-wave radiation unit and said radio-wave reception unit, based on a correlation between a time-delay from transmission time of the transmission signal until reception time of the reception signal and the distance along a transmission path according to route's positions on said radio-wave radiation unit and said radio-wave reception unit in the transmission path through which the transmission signal passes after its transmission until reception as the reception signal, by comparing a code sequence of a spread spectrum signal extracted from the reception signal with a code sequence of a spread spectrum signal in the transmission signal; and a malfunction-information detection unit configured to determine that a malfunction is present in the unit to which said terminator is connected, out of said radio-wave radiation unit and said radio-wave reception unit, when the amplitude of the reception signal is larger than a predetermined value in the range bin corresponding to the far-end position.

8. An intrusion-object detection system, comprising:

a radio-wave radiation unit in a cable form with one end thereof as a feed end and the other end thereof as a far end, configured to radiate as a radio wave, a transmission signal on which a spread spectrum signal is superimposed being fed into said radio-wave radiation unit from the feed end;

a radio-wave reception unit configured to receive the radio wave, in a cable form, placed approximately in parallel with said radio-wave radiation unit;

a terminator configured to absorb the radio wave, connected to the far end of either said radio-wave radiation unit or said radio-wave reception unit;

a reflector configured to reflect the radio wave connected to the far end of either said radio-wave radiation unit or said radio-wave reception unit to which said terminator is not connected;

a signal reception unit configured to receive the transmission signal as a reception signal, connected to an end, on the feed-end side, of said radio-wave reception unit;

a signal demodulation unit configured to define the reception signal so as to calculate the amplitude of the reception signal with respect to range bins each correlated with a distance from a position of the feed end, on said radio-wave radiation unit and said radio-wave reception unit, based on a correlation between a time-delay from transmission time of the transmission signal until reception time of the reception signal and the distance along a transmission path according to route's positions on said radio-wave radiation unit and said radio-wave reception unit in the transmission path through which the transmission signal passes after its transmission until reception as the reception signal, by comparing a code sequence of a spread spectrum signal extracted from the reception signal with a code sequence of a spread spectrum signal in the transmission signal; and a malfunction-position detection unit configured to detect, when there exists a range bin, corresponding to a position on the opposite side of the feed end with respect to the far end, in which the amplitude of the reception signal is larger than a predetermined value, by obtaining the distance X from the position corresponding to said range bin to the far end, that a malfunction is present in the unit to which said terminator is connected, out of said radio-wave radiation unit and said radio-wave reception unit, and for defining a position of the malfunction based on the distance X and the length of said radio-wave radiation unit and said radio-wave reception unit.

9. An intrusion-object detection system, comprising:

a radio-wave radiation unit in a cable form with one end thereof as a feed end and the other end thereof as a far end, configured to radiate as a radio wave, a transmission signal on which a spread spectrum signal is superimposed being fed into said radio-wave radiation unit from the feed end;

a radio-wave reception unit configured to receive the radio wave, in a cable form, placed approximately in parallel with said radio-wave radiation unit;

a terminator configured to absorb the radio wave, provided for each of said radio-wave radiation unit and said radio-wave reception unit;

a reflector configured to reflect the radio wave, provided for each of said radio-wave radiation unit and said radio-wave reception unit;

a changeover unit provided for each of said radio-wave radiation unit and said radio-wave reception unit, configured to select either said terminator or said reflector, to connect the same to said corresponding radio-wave radiation unit and radio-wave reception unit each;

a signal reception unit configured to receive the transmission signal as a reception signal, connected to an end, on the feed-end side, of said radio-wave reception unit;

a signal demodulation unit configured to define the reception signal so as to calculate the amplitude of the reception signal with respect to range bins each correlated with a distance from a position of the feed end, on said radio-wave radiation unit and said radio-wave reception unit, based on a correlation between a time-delay from transmission time of the transmission signal until reception time of the reception signal and the distance along a transmission path according to route's positions on said radio-wave radiation unit and said radio-wave reception unit in the transmission path through which the transmission signal passes after its transmission until reception as the reception signal, by comparing a code sequence of a spread spectrum signal extracted from the reception signal with a code sequence of a spread spectrum signal in the transmission signal; and a malfunction-information detection unit configured to determine that a malfunction is present in the unit to which said terminator is connected, out of said radio-wave radiation unit and said radio-wave reception unit, when the amplitude of the reception signal is larger than a predetermined value in the range bin corresponding to the far-end position.

10. An intrusion-object detection system, comprising:

a radio-wave radiation unit in a cable form with one end thereof as a feed end and the other end thereof as a far end, configured to radiate as a radio wave, a transmission signal on which a spread spectrum signal is superimposed being fed into said radio-wave radiation unit from the feed end;

a radio-wave reception unit configured to receive the radio wave, in a cable form, placed approximately in parallel with said radio-wave radiation unit;

a terminator configured to absorb the radio wave, provided for each of said radio-wave radiation unit and said radio-wave reception unit;

a reflector configured to reflect the radio wave, provided for each of said radio-wave radiation unit and said radio-wave reception unit;

a changeover unit provided for each of said radio-wave radiation unit and said radio-wave reception unit, configured to select either said terminator or said reflector, to connect the same to said corresponding radio-wave radiation unit and radio-wave reception unit each;

a signal reception unit configured to receive the transmission signal as a reception signal, connected to an end, on the feed-end side, of said radio-wave reception unit;

a signal demodulation unit configured to define the reception signal so as to calculate the amplitude of the reception signal with respect to range bins each correlated with a distance from a position of the feed end, on said radio-wave radiation unit and said radio-wave reception unit, based on a correlation between a time-delay from transmission time of the transmission signal until reception time of the reception signal and the distance along a transmission path according to route's positions on said radio-wave radiation unit and said radio-wave reception unit in the transmission path through which the transmission signal passes after its transmission until reception as the reception signal, by comparing a code sequence of a spread spectrum signal extracted from the reception signal with a code sequence of a spread spectrum signal in the transmission signal; and a malfunction-position detection unit configured to determine, when there exists a range bin, corresponding to a position on the opposite side of the feed end with respect to the far end, in which the amplitude of the reception signal is larger than a predetermined value, by obtaining the distance X from the position corresponding to said range bin to the far end, that a malfunction is present in the unit to which said terminator is connected, out of said radio-wave radiation unit and said radio-wave reception unit, and for defining a position of the malfunction based on the distance X and the length of said radio-wave radiation unit and said radio-wave reception unit.

* * * * *